US009606467B2

(12) United States Patent
Iwami et al.

(10) Patent No.: US 9,606,467 B2
(45) Date of Patent: Mar. 28, 2017

(54) MAGNETIC CARRIER FOR ELECTROPHOTOGRAPHIC DEVELOPER AND PROCESS FOR PRODUCING THE SAME, AND TWO-COMPONENT SYSTEM DEVELOPER

(75) Inventors: Katsuji Iwami, Hiroshima-ken (JP); Shigenori Harada, Hiroshima-ken (JP); Eiichi Kurita, Hiroshima-ken (JP); Kaori Kinoshita, Hiroshima-ken (JP)

(73) Assignee: TODA KOGYO CORPORATION, Hiroshima (JP)

( * ) Notice: Subject to any disclaimer, the term of this patent is extended or adjusted under 35 U.S.C. 154(b) by 0 days.

(21) Appl. No.: 13/375,581

(22) PCT Filed: Jun. 4, 2010

(86) PCT No.: PCT/JP2010/059512
§ 371 (c)(1),
(2), (4) Date: Jan. 23, 2012

(87) PCT Pub. No.: WO2010/140677
PCT Pub. Date: Dec. 9, 2010

(65) Prior Publication Data

US 2012/0129087 A1 May 24, 2012

(30) Foreign Application Priority Data

Jun. 4, 2009 (JP) ..... 2009-135417

(51) Int. Cl.
*G03G 9/107* (2006.01)
*G03G 9/113* (2006.01)

(52) U.S. Cl.
CPC ..... *G03G 9/107* (2013.01); *G03G 9/1075* (2013.01); *G03G 9/1133* (2013.01);
(Continued)

(58) Field of Classification Search
CPC ..... G03G 9/107; G03G 9/10; G03G 9/1075; G03G 9/0821; G03G 9/08797; G03G 9/0819
(Continued)

(56) References Cited

U.S. PATENT DOCUMENTS 5,108,862 A 4/1992 Kishimoto et al.
5,654,120 A 8/1997 Hakata et al.
(Continued)

FOREIGN PATENT DOCUMENTS

JP 3-192268 8/1991
JP 05/100494 4/1993
(Continued)

OTHER PUBLICATIONS

Search Report in EP 10 78 3459 dated Nov. 2, 2012.
International Search Report for PCT/JP2010/059512, mailed Aug. 10, 2010.

*Primary Examiner* — Hoa V Le
(74) *Attorney, Agent, or Firm* — Nixon & Vanderhye P.C.

(57) ABSTRACT

The present invention relates to a magnetic carrier for an electrophotographic developer comprising spherical magnetic composite particles comprising a phenol resin as a binder and ferromagnetic iron oxide particles bonded to each other through the phenol resin, wherein the spherical magnetic composite particles have a ten-point mean roughness Rz of 0.3 to 2.0 μm. The magnetic carrier for an electrophotographic developer according to the present invention exhibits an excellent durability against peeling-off and abrasion of coating resins formed thereon and a high stability to mechanical stress exerted onto the carrier, is free from occurrence of spent toner, can be stably held over a long period of time without occurrence of fogging and uneven-
(Continued)

ness in density of toner images, and can keep high-quality images with an excellent gradation for a long period of time.

14 Claims, 4 Drawing Sheets

(52) U.S. Cl.
CPC ..... *G03G 9/1134* (2013.01); *G03G 9/1135* (2013.01); *G03G 9/1136* (2013.01)

(58) Field of Classification Search
USPC ..... 430/111.3, 111.31, 111, 4
See application file for complete search history.

(56) References Cited

U.S. PATENT DOCUMENTS

| | | | | |
|---|---|---|---|---|
| 5,731,085 | A * | 3/1998 | Hakata et al. | 428/402 |
| 6,017,667 | A * | 1/2000 | Hakata | 430/111.35 |
| 6,106,987 | A * | 8/2000 | Hakata et al. | 430/111.35 |
| 6,124,067 | A * | 9/2000 | Mikuriya et al. | 430/100 |
| 6,159,648 | A * | 12/2000 | Baba et al. | 430/110.4 |
| 6,165,663 | A * | 12/2000 | Baba et al. | 430/111.3 |
| 6,372,400 | B1 * | 4/2002 | Yoshizaki et al. | 430/111.32 |
| 6,485,877 | B2 * | 11/2002 | Hakata | 430/111.35 |
| 6,506,531 | B1 | 1/2003 | Hakata et al. | |
| 2007/0172748 | A1 | 7/2007 | Inoue et al. | |
| 2007/0243479 | A1 | 10/2007 | Yoshihara et al. | |

FOREIGN PATENT DOCUMENTS

| | | |
|---|---|---|
| JP | 9-311505 | 12/1997 |
| JP | 2000-199985 | 7/2000 |
| JP | 2005-084457 | 3/2005 |
| JP | 2006-18129 | 1/2006 |
| JP | 2007-102052 | 4/2007 |
| JP | 2007-199267 | 8/2007 |
| JP | 2007-322892 | 12/2007 |
| JP | 2008-040270 | 2/2008 |
| JP | 2008-083098 | 4/2008 |
| JP | 2008-83098 | 4/2008 |
| JP | 2008-96623 | 4/2008 |
| JP | 2009/300957 | 12/2009 |
| JP | 2010/06045 | 3/2010 |
| JP | 2010/055086 | 3/2010 |

* cited by examiner

MAGNETIC CARRIER FOR ELECTROPHOTOGRAPHIC DEVELOPER AND PROCESS FOR PRODUCING THE SAME, AND TWO-COMPONENT SYSTEM DEVELOPER

This application is the U.S. national phase of International Application No. PCT/JP2010/059512, filed 4 Jun. 2010, which designated the U.S. and claims priority to Japan Application No. 2009-135417, filed 4 Jun. 2009, the entire contents of each of which are hereby incorporated by reference.

TECHNICAL FIELD

The present invention relates to a magnetic carrier for an electrophotographic developer, and more particularly, to a magnetic carrier for an electrophotographic developer which is provided on a surface thereof with fine irregularities to thereby exhibit an excellent adhesion property when coated with a resin and prevent occurrence of abrasion and peeling-off of a coating layer formed thereon, and which exhibits a good stability against mechanical stress exerted on the carrier and shows an adequate electric resistance value with a less voltage dependency to thereby enable development of images with an excellent gradation, as well as a two-component developer comprising the magnetic carrier for an electrophotographic developer and a toner.

BACKGROUND ART

As is well known in the art, in electrophotographic developing methods, in general, a photosensitive member formed of a photoconductive material such as selenium, OPC (organic semiconductor), α-Si or the like has been used to form an electrostatic latent image thereon by various means. Then, by using a magnetic brush method or the like, a toner having a polarity reverse to that of the latent image is attached thereonto by the electrostatic force to develop the latent image.

In the above developing step, there is used a two-component system developer comprising a toner and a carrier. The carrying particles called a magnetic carrier acts for imparting an appropriate positive or negative electric charge amount to the toner by frictional electrification, and delivering the toner into a developing zone near the surface of the photosensitive member on which the latent image is formed, by a developing sleeve in which magnets are accommodated, using a magnetic force thereof.

In recent years, copying machines or printers of the above electrophotographic developing type have been rapidly digitalized and formed into a composite structure, so that there is a further increasing demand for those apparatuses having a high performance, a high image quality and a high copying or printing speed. With the market's requirements for personalization and space saving, etc., reduction in size of the electrophotographic image-forming apparatuses has been promoted. In particular, it has been demanded to enhance an image quality of full-color images up to a higher level close to a high-grade printing or a silver salt photo. For this reason, in order to faithfully visualize fine latent images for a long period of time, it is important to keep stable electrification of the developer. Thus, in order to stably maintain these properties of the developer, it is required that a carrier used in the developer has a long service life such that various properties of the carrier having the electrification performance such as a charging property and an electric resistance can be stably maintained over a long period of time.

Hitherto, there tends to arise such a problem that the carrier constituting the developer is allowed to remain within a developing device and subjected to repeated frictional contact with a toner, and therefore suffers from significant change in surface conditions thereof with time, resulting in undesirable change in quality of the obtained images. Such a problem tends to be mainly caused by two phenomena, namely, a phenomenon that the toner is firmly adhered onto the surface of the respective carrier particles, so that the charging property inherent to the carrier is lost (i.e., a so-called spent toner), and such a phenomenon that a resin coating layer formed on the surface of the respective carrier particles is peeled off owing to friction with the toner, so that leak sites are formed thereon, thereby causing significant change in electric resistance thereof.

In view of these problems, in order to prevent the carrier from suffering from occurrence of spent toner, there has been conventionally proposed the method in which the surface of the carrier is coated with various resins. For example, it is known that the surface of the respective carrier core particles is coated with a releasable resin such as a fluororesin and a silicone resin. Such a coated carrier not only can be imparted with various functions such as a good charging property and a well-controlled electric resistance, but also hardly suffers from occurrence of spent toner upon the development because the surface thereof is coated with the low-surface energy substance. As a result, the carrier has a stable charge amount, and the developer using the carrier exhibits a long service life.

On the other hand, the carrier has been required to have a certain suitable electric resistance ranging from about $1\times10^{8}$ to $1\times10^{16}$ Ω·cm. More specifically, when the carrier has an electric resistance value as low as $1\times10^{6}$ Ω·cm like the carrier comprising iron particles, there tend to arise the problems such as attachment of the carrier to image-bearing portions of a photosensitive member owing to injection of electric charges from a sleeve, and occurrence of defective latent images or lack of obtained images owing to escape of latent image-forming electric charges through the carrier. Also, when a thickness of the insulating resin layer is increased, the electric resistance value thereof tends to become too high, so that it may be difficult to leak electric charges of the carrier, and the toner has an excessively high charge amount. As a result, although images having a sharp edge are obtained, there tends to arise such a problem that an image screen having a large displaying area has a considerably low image density at a central portion thereof.

Further, when the electric resistance value of the carrier has a large voltage dependency, the obtained image tends to generally has no gradation, so that even when using the carrier for a developer in copying machines or printers, it may be difficult to obtain images having a high image quality, and the applications thereof tend to be limited.

In general, as the carrier constituting a two-component system developer, there are well known an iron powder carrier, a ferrite carrier, a carrier of a binder type in which magnetic particles are dispersed in a binder resin, and a carrier of a coated type in which a magnetic material is coated with a resin.

The iron powder carrier and ferrite carrier are usually used in the form of resin-coated particles. However, since the iron powder carrier has a true specific gravity as large as 7 to 8 g/cm$^3$ whereas the ferrite carrier has a true specific gravity as large as 4.5 to 5.5 g/cm$^3$, a large driving force is required for stirring these carriers in the developing device, resulting in significant mechanical damage to the device, occurrence of spent toner as well as deterioration in charging property of the carrier itself and facilitated damage to the photosensitive member. Further, since the adhesion between the surface of the iron powder carrier or ferrite carrier and the coating resin is not good, the coating resin tends to be gradually peeled off during use with the time, thereby causing variation in the charging property. As a result, the problems such as formation of defective images and adhesion of the carrier tend to be caused.

The carrier of a magnetic material-dispersed type comprising spherical magnetic composite particles formed from magnetic iron oxide particles and a phenol resin as described in Japanese Patent Application Laid-Open (KOKAI) No. 2-220068 is far excellent in adhesion to coating resins as compared to the iron powder carrier or ferrite carrier and, therefore, suffers from substantially no problem concerning peeling-off of the coating resins therefrom during use.

With the recent progress of coloration, there is an increasing demand for carriers which can be enhanced in various properties for obtaining high-quality images and has a long service life capable of stably maintaining the various properties over a long period of time. However, when using the above carriers, there tends to arise such a problem that the coating resins are abraded owing to impingement between particles, mechanical agitation of the particles within a developing device and thermal stress thereon, or an extent of prevention of peeling-off of the coating resins from the carrier tends to be insufficient. In addition, since the spherical magnetic composite particles constituting a core material of the magnetic material-dispersed type carrier have a low electric resistance value, when the resin coating layer on the carrier suffers from peeling-off, there tend to arise the problems such as leak of electric charges upon the development and poor gradation owing to a large voltage dependency of the electric resistance value.

In particular, in recent years, with the shifting to maintenance-free systems, a developer used therein is often required to have a durability over a long period of time which may correspond to almost a whole service life of the maintenance-free machines. Therefore, it is strongly required to provide the magnetic carrier which is free from peeling-off of the coating resin owing to abrasion and occurrence of spent toner, and exhibits a sufficient electric resistance with a low voltage dependency.

Conventionally, there are known the methods directed to surface conditions of a magnetic carrier in which irregularities are formed on a surface of the respective carrier particles to control a surface configuration thereof.

For example, there are known the technique of controlling surface conditions of resin-dispersed type carrier particles or spray-dried carrier particles according to a ten-point mean roughness (Rz) and a standard deviation of roughness thereof (Patent Document 1); the techniques of forming irregularities on a surface of respective carrier particles by coating the particles with a resin comprising a protrusion-forming material to control a surface configuration of the respective particles according to a ten-point mean roughness (Rz) or according to a difference in height between the irregularities and the number of protrusions present thereon (Patent Documents 2 and 3); the technique of controlling surface conditions of carrier particles according to an arithmetic mean roughness Ra and a mean spacing of profile irregularities Sm thereof by varying calcining conditions (Patent Document 4); the technique of controlling surface conditions of carrier particles according to an arithmetic mean roughness Ra and a depth of a groove between the adjacent protrusions by varying calcining conditions to form stripe-patterned protruded portions on the surface of the respective particles (Patent Document 5); the technique of subjecting carrier particles to acid treatment to form a honeycomb-shaped surface thereon, and controlling a BET specific surface area of the particles so as to satisfy a calculation formula: $S=a\times D^b$ (wherein S: BET specific surface area ($m^2/g$) of core particles; D: average particle diameter (μm) of the core particles; a: coefficient, $3\leq a\leq 22$; b: coefficient, $b=-1.05$) (Patent Document 6); the technique of forming fine irregularities owing to plate-shaped metal oxide particles on a surface of respective particles of a magnetic carrier to control surface conditions of the magnetic carrier according to a fluidity rate thereof (Patent Document 7); etc.

Further, there is known the method in which composite particles comprising ferromagnetic iron oxide fine particles and a cured phenol resin are coated with a melamine resin. For example, there are known the technique of coating a surface of respective composite core particles comprising ferromagnetic fine particles and a cured phenol resin with a melamine resin to impart a high electric resistance thereto (Patent Document 8); the technique of forming a coating layer comprising a copolymer resin obtained by curing at least one resin selected from a melamine resin, an aniline resin and a urea resin with a phenol resin, on a surface of respective composite core particles comprising iron oxide particles and a cured phenol resin to control an electric resistance value of a carrier (Patent Document 9); etc.

PRIOR DOCUMENTS

Patent Documents

Patent Document 1: Japanese Patent Application Laid-Open (KOKAI) No. 2008-83098
Patent Document 2: Japanese Patent Application Laid-Open (KOKAI) No. 2006-18129
Patent Document 3: Japanese Patent Application Laid-Open (KOKAI) No. 2002-287431
Patent Document 4: Japanese Patent Application Laid-Open (KOKAI) No. 2008-40270
Patent Document 5: Japanese Patent Application Laid-Open (KOKAI) No. 2008-250214
Patent Document 6: Japanese Patent Application Laid-Open (KOKAI) No. 2007-101731
Patent Document 7: Japanese Patent Application Laid-Open (KOKAI) No. 2003-323007
Patent Document 8: Japanese Patent Application Laid-Open (KOKAI) No. 3-192268
Patent Document 9: Japanese Patent Application Laid-Open (KOKAI) No. 9-311505

DISCLOSURE OF THE INVENTION

Means for Solving the Problems

When controlling irregularities on the surface of the carrier particles according to the above conventional techniques, the resulting carrier can be enhanced in adhesion to the coating resins and durability. However, adverse influences such as increased load on protrusions of the irregularities on the surface of the respective particles tend to be caused owing to impingement between the particles, mechanical agitation of the particles within a developing device and thermal stress thereon, so that the coating resins tend to be hardly prevented from suffering from abrasion and peeling-off. As a result, the above conventional problems have still remained unsolved. Further, in the respective conventional techniques in which the composite particles comprising ferromagnetic iron oxide fine particles and a cured phenol resin are coated with a melamine resin as described in the above Patent Documents 8 and 9, there still tends to occur such a problem that an electric resistance upon the development cannot be maintained at an adequate level. Thus, any of the conventional techniques failed to fully solve the conventional problems.

The present invention has been accomplished to solve the above conventional problems. An object of the present invention is to provide a magnetic carrier used for an electrophotographic developer which exhibits an excellent durability against peeling-off and abrasion of coating resins formed thereon and a high stability to mechanical stress exerted on the carrier, is free from occurrence of spent toner, can be stably held over a long period of time without occurrence of fogging and unevenness in density of toner images, further can maintain an adequate electric resistance value upon the development, and is capable of exhibiting a high durability, a good reproducibility of uniform and high-density solid images, as well as can keep high-quality images with an excellent gradation for a long period of time, as well as a two-component system developer comprising the magnetic carrier for an electrophotographic developer and a toner.

Means for Solving the Problems

The object or technical task of the present invention can be achieved by the following Inventions.

That is, according to the present invention, there is provided a magnetic carrier for an electrophotographic developer comprising spherical magnetic composite particles comprising a phenol resin as a binder and ferromagnetic iron oxide particles bonded to each other through the phenol resin, wherein the spherical magnetic composite particles have a ten-point mean roughness Rz of 0.3 to 2.0 μm (Invention 1).

Also, according to the present invention, there is provided the magnetic carrier for an electrophotographic developer as described in the above Invention 1, wherein a maximum height Ry as measured on a surface of the respective spherical magnetic composite particles is in the range of 0.7 to 2.5 μm (Invention 2).

Also, according to the present invention, there is provided the magnetic carrier for an electrophotographic developer as described in the above Invention 1 or 2, wherein an arithmetic mean roughness Ra as measured on a surface of the respective spherical magnetic composite particles is in the range of 0.1 to 0.9 μm, and a mean spacing Sm of profile irregularities thereon is in the range of 0.6 to 6.0 μm (Invention 3).

Also, according to the present invention, there is provided the magnetic carrier for an electrophotographic developer as described in any one of the above Inventions 1 to 3, wherein the magnetic carrier for an electrophotographic developer has an electric resistance value $R_{100}$ of $1\times10^{8}$ Ω·cm to $1\times10^{14}$ Ω·cm as measured when applying a voltage of 100 V thereto, and an electric resistance value $R_{300}$ of the magnetic carrier as measured when applying a voltage of 300 V thereto is controlled such that a ratio of $R_{300}/R_{100}$ satisfies the formula: $0.15\leq R_{300}/R_{100}\leq 1$ (Invention 4).

Also, according to the present invention, there is provided the magnetic carrier for an electrophotographic developer as described in any one of the above Inventions 1 to 4, further comprising a coating layer comprising a melamine resin (invention 5).

Also, according to the present invention, there is provided the magnetic carrier for an electrophotographic developer as described in any one of the above Inventions 1 to 5, further comprising a coating layer comprising at least one resin selected from the group consisting of a silicone-based resin, a fluororesin, an acrylic resin and a styrene-acrylic resin (Invention 6).

Also, according to the present invention, there is provided the magnetic carrier for an electrophotographic developer as described in any one of the above Inventions 1 to 6, wherein a total content of the ferromagnetic iron oxide particles in the spherical magnetic composite particles is 80 to 99% by weight; the ferromagnetic iron oxide particles are constituted from ferromagnetic iron oxide particles (a) and ferromagnetic iron oxide particles (b) which are different in average particle diameter from each other; a ratio of an average particle diameter (ra) of the ferromagnetic iron oxide particles (a) having a larger average particle diameter to an average particle diameter (rb) of the ferromagnetic iron oxide particles (b) having a smaller average particle diameter (ra/rb) is more than 1; a content of the ferromagnetic iron oxide particles (a) is 1 to 50% by weight based on a total amount of the ferromagnetic iron oxide particles (a) and the ferromagnetic iron oxide particles (b); and the ferromagnetic iron oxide particles (a) and the ferromagnetic iron oxide particles (b) respectively have any shape selected from the group consisting of a spherical shape, a hexahedral shape, an octahedral shape, a polyhedral shape and an amorphous shape (Invention 7).

Also, according to the present invention, there is provided the magnetic carrier for an electrophotographic developer as described in any one of the above Inventions 1 to 6, wherein the spherical magnetic composite particles further comprise dielectric particles having a relative dielectric constant of not less than 50 (Invention 8).

Also, according to the present invention, there is provided the magnetic carrier for an electrophotographic developer as described in the above Invention 8, wherein the dielectric particles are formed of at least one material selected from the group consisting of titanium oxide, a titanate and a zirconate (Invention 9).

Also, according to the present invention, there is provided the magnetic carrier for an electrophotographic developer as described in the above Invention 8 or 9, wherein a total content of the dielectric particles and the ferromagnetic iron oxide particles in the spherical magnetic composite particles is 80 to 99% by weight; and a content of the dielectric particles in the spherical magnetic composite particles is 1 to 50% by weight based on a total amount of the ferromagnetic iron oxide particles and the dielectric particles (Invention 10).

Also, according to the present invention, there is provided the magnetic carrier for an electrophotographic developer as described in any one of the above Inventions 8 to 10, wherein the ferromagnetic iron oxide particles consist of one kind of ferromagnetic iron oxide particles (b') solely; a ratio of an average particle diameter (rc) of the dielectric particles to an average particle diameter (rb') of the ferromagnetic iron oxide particles (b') (rc/rb') is more than 1; and the ferromagnetic iron oxide particles (b') have any particle shape selected from the group consisting of a spherical shape, a hexahedral shape, an octahedral shape, a polyhedral shape and an amorphous shape (Invention 11).

Also, according to the present invention, there is provided the magnetic carrier for an electrophotographic developer as described in any one of the above Inventions 8 to 10, wherein the ferromagnetic iron oxide particles are constituted from ferromagnetic iron oxide particles (a") and ferromagnetic iron oxide particles (b") which are different in average particle diameter from each other; a ratio of an average particle diameter (ra") of the ferromagnetic iron oxide particles (a") to an average particle diameter (rb") of the ferromagnetic iron oxide particles (b") (ra"/rb") is more than 1; a ratio of the average particle diameter (rc) of the dielectric particles to the average particle diameter (rb") of the ferromagnetic iron oxide particles (b") (rc/rb") is more than 1; a content of the ferromagnetic iron oxide particles (a") is less than 49% by weight based on a total amount of the ferromagnetic iron oxide particles (a"), the ferromagnetic iron oxide particles (b") and the dielectric particles; and the ferromagnetic iron oxide particles (a") and the ferromagnetic iron oxide particles (b") respectively have any shape selected from the group consisting of a spherical shape, a hexahedral shape, an octahedral shape, a polyhedral shape and an amorphous shape (Invention 12).

In addition, according to the present invention, there is provided a process for producing the magnetic carrier for an electrophotographic developer as defined in any one of the above Inventions 1 to 7, said process comprising the step of mixing and reacting mixed particles comprising two kinds of ferromagnetic iron oxide particles which are different in average particle diameter from each other, with a phenol compound and an aldehyde compound in an aqueous medium while stirring to obtain a cured product, thereby producing spherical magnetic composite particles comprising the ferromagnetic iron oxide particles and a phenol resin, wherein the spherical magnetic composite particles are provided, on a surface thereof, with fine irregularities owing to a shape of the ferromagnetic iron oxide particles having a larger average particle diameter (Invention 13).

Also, according to the present invention, there is provided a process for producing the magnetic carrier for an electrophotographic developer as defined in any one of the above Inventions 8 to 11, said process comprising the step of reacting ferromagnetic iron oxide particles and dielectric particles having a relative dielectric constant of not less than 50, with a phenol compound and an aldehyde compound in an aqueous medium to obtain a cured product, thereby producing spherical magnetic composite particles comprising the ferromagnetic iron oxide particles, the dielectric particles and a phenol resin, wherein the spherical magnetic composite particles are provided, on a surface thereof, with fine irregularities owing to a shape of the dielectric particles (Invention 14).

Also, according to the present invention, there is provided a process for producing the magnetic carrier for an electrophotographic developer as defined in any one of the above Inventions 8 to 10 and 12, said process comprising the step of reacting two kinds of ferromagnetic iron oxide particles which are different in average particle diameter from each other and dielectric particles having a relative dielectric constant of not less than 50, with a phenol compound and an aldehyde compound in an aqueous medium to obtain a cured product, thereby producing spherical magnetic composite particles comprising the ferromagnetic iron oxide particles, the dielectric particles and a phenol resin, wherein the spherical magnetic composite particles are provided, on a surface thereof, with fine irregularities owing to shapes of the ferromagnetic iron oxide particles having a larger average particle diameter and the dielectric particles (Invention 15).

Also, according to the present invention, there is provided the process as described in any one of the above Inventions 13 to 15, further comprising the step of adding an acid aqueous solution comprising an acid having an acid dissociation constant pKa of 3 to 6 as an acid catalyst and a methylol melamine aqueous solution to the aqueous medium comprising the spherical magnetic composite particles obtained in the step for production of the spherical magnetic composite particles, to form a coating layer of a melamine resin on the respective spherical magnetic composite particles (Invention 16).

Further, according to the present invention, there is provided a two-component system developer comprising the magnetic carrier for an electrophotographic developer as defined in any one of the above Inventions 1 to 12 and a toner (Invention 17).

Effect of the Invention

The magnetic carrier for an electrophotographic developer according to the present invention is provided on a surface thereof with fine irregularities which are well-controlled (with respect to surface roughness, distance between the irregularities, height of the irregularities and shape of the irregularities), and therefore exhibits a very excellent adhesion property upon coating with resins and an excellent durability against peeling-off and abrasion of the resulting coating layer and a high stability to mechanical stress exerted onto the carrier, and further can be stably maintained over a long period of time without occurrence of spent toner, i.e., is excellent in life elongation property. Furthermore, the magnetic carrier is well controlled to exhibit an adequate electric resistance value which has a less voltage dependency to thereby obtain images with an excellent gradation, and therefore can be suitably used as a magnetic carrier for an electrophotographic developer.

The two-component system developer according to the present invention comprises the magnetic carrier which has an excellent durability and is well controlled in electric resistance, and therefore can be suitably used as a developer adaptable to high image quality and high copying or printing speed.

PREFERRED EMBODIMENTS FOR CARRYING OUT THE INVENTION

Figure 1:
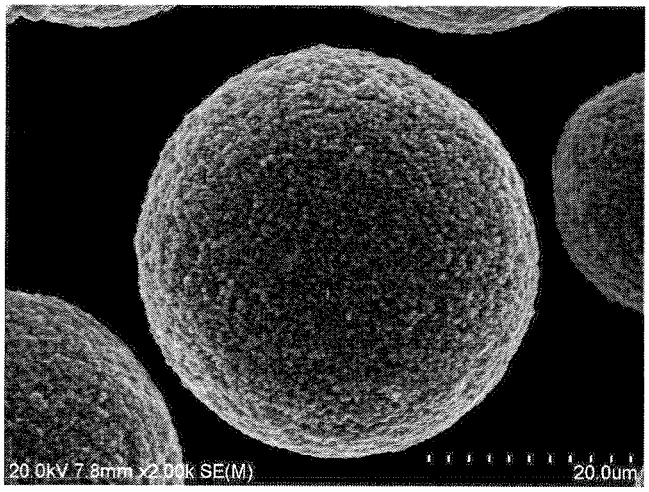
FIG. 1 is an electron micrograph showing a particle structure of spherical magnetic composite particles obtained in Example 1-1 (magnification: ×2000).

The present invention is described in detail below. First, the magnetic carrier for an electrophotographic developer according to the present invention (hereinafter referred to merely as a "magnetic carrier") is described.

The surface of the magnetic carrier according to the present invention has a ten-point mean roughness Rz of 0.3 to 2.0 μm. When the ten-point mean roughness Rz is less than 0.3 μm, the surface of the magnetic carrier tends to be relatively even and smooth so that adhesion to a resin coating tends to be lowered, thereby failing to attain a sufficient durability. When the ten-point mean roughness Rz is more than 2.0 μm, protruded portions on the surface of the magnetic carrier tend to suffer from significantly large loads owing to friction, abrasion, mechanical stress, etc., thereby also failing to attain a sufficient durability. The ten-point mean roughness Rz of the surface of the magnetic carrier is preferably 0.3 to 1.9 μm.

The maximum height Ry as measured on the surface of the magnetic carrier according to the present invention is preferably in the range of 0.7 to 2.5 μm. When the maximum height Ry is less than 0.7 μm, the magnetic carrier tends to fail to have adequate irregularities on the surface thereof, thereby failing to exhibit a sufficient adhesion property upon coating with resins. When the maximum height Ry is more than 2.5 μm, protruded portions on the surface of the magnetic carrier tend to suffer from significantly large loads owing to friction, abrasion, mechanical stress, etc., so that the irregularities on the surface thereof tend to be removed, thereby also failing to attain a sufficient durability. The maximum height Ry on the surface of the magnetic carrier is more preferably in the range of 0.7 to 2.45 μm.

The arithmetic mean roughness Ra as measured on the surface of the magnetic carrier according to the present invention is preferably in the range of 0.1 to 0.9 μm, more preferably 0.1 to 0.8 μm and especially preferably 0.1 to 0.5 μm. The mean spacing of profile irregularities Sm on the surface of the magnetic carrier according to the present invention is preferably in the range of 0.6 to 6.0 μm, more preferably 0.6 to 5.5 μm and especially preferably 0.6 to 3.0 μm. When the arithmetic mean roughness Ra and the mean spacing Sm of profile irregularities lie within the above respective specified ranges, the magnetic carrier can exhibit a higher adhesion property.

When measuring an electric resistance value of the magnetic carrier according to the present invention, the electric resistance value $R_{100}$ of the magnetic carrier when applying a voltage of 100 V thereto is preferably $1\times10^{8}$ Ω·cm to $1\times10^{14}$ Ω·cm. When the electric resistance value $R_{100}$ of the magnetic carrier lies within the above specified range, it is possible to further suppress deposition of the carrier onto an image-forming portion of a photosensitive member owing to injection of charges from a sleeve thereinto or suppress disturbance of latent images owing to leakage of charges on the latent images through the carrier or occurrence of defective images.

When measuring an electric resistance value of the magnetic carrier according to the present invention, the electric resistance value $R_{300}$ of the magnetic carrier when applying a voltage of 300 V thereto is preferably $1\times10^{8}$ Ω·cm to $1\times10^{14}$ Ω·cm.

In the magnetic carrier according to the present invention, the ratio of the electric resistance value $R_{300}$ as measured when applying a voltage of 300 V thereto to the electric resistance value $R_{100}$ measured when applying a voltage of 100 V thereto satisfies the relationship represented by the $0.1\leq R_{300}/R_{100}\leq1.0$. When the ratio of $R_{300}/R_{100}$ is controlled to lie within the above specified range, it is possible to further reduce a voltage dependency of the electric resistance value.

The magnetic carrier according to the present invention preferably has an average particle diameter of 10 to 100 μm. When the average particle diameter of the magnetic carrier is less than 10 μm, the magnetic carrier tends to suffer from secondary aggregation. When the average particle diameter of the magnetic carrier is more than 100 μm, the magnetic carrier tends to be deteriorated in mechanical strength, thereby failing to attain a clear image. The average particle diameter of the magnetic carrier is more preferably 20 to 70 μm.

The magnetic carrier according to the present invention preferably has a specific gravity of 2.5 to 4.5 (g/cm$^3$) and more preferably 2.5 to 4.2 (g/cm$^3$).

The magnetic carrier according to the present invention preferably has a saturation magnetization value of 20 to 100 Am$^2$/kg and more preferably 40 to 85 Am$^2$/kg.

In the magnetic carrier according to the present the sphericity represented by the following formula is preferably 1.0 to 1.4.

$$\text{Sphericity}=l/w$$

wherein l is an average major axis diameter of spherical magnetic composite particles; and w is an average minor axis diameter of spherical magnetic composite particles.

When measuring the electric resistance value of the magnetic carrier for an electrophotographic developer according to the present invention which comprises spherical magnetic composite particles and a surface coating layer produced mainly from a resin and formed on the surface of the respective particles, the electric resistance $R_{100}$ thereof as measured when applying a voltage of 100 V thereto is preferably $1\times10^{8}$ to $1\times10^{16}$ Ω·cm. Even when the electric resistance $R_{100}$ of the magnetic carrier as measured when applying a voltage of 100 V thereto is more than $1\times10^{16}$ Ω·cm, electric charges on the carrier tend to be hardly leaked therefrom and further the charge amount of the toner tends to become increased, thereby enabling formation of images having a sharp edge. However, in such a case, there tends to arise such a problem that the image density on central portions of a large image screen is considerably low. The electric resistance value $R_{130}$ of the magnetic carrier as measured when applying a voltage of 100 V thereto is more preferably $1\times10^{9}$ to $5.0\times10^{15}$ Ω·cm.

When measuring the electric resistance value of the magnetic carrier for an electrophotographic developer according to the present invention, the electric resistance value $R_{300}$ thereof as measured when applying a voltage of 300 V thereto is preferably $1\times10^{8}$ to $1.0\times10^{16}$ Ω·cm.

In the magnetic carrier for an electrophotographic developer according to the present invention, the ratio of the electric resistance value $R_{300}$ thereof as measured when applying a voltage of 300 V thereto to the electric resistance value $R_{100}$ thereof as measured when applying a voltage of 100 V thereto ($R_{300}/R_{100}$) is preferably 0.1 to 1.0, more preferably 0.15 to 1.0 and especially preferably 0.20 to 1.0.

Next, the process for producing the magnetic carrier according to the present invention is described.

That is, the spherical magnetic composite particles constituting the magnetic carrier according to the present invention may be produced by reacting a phenol compound and an aldehyde compound with each other in the co-existence of ferromagnetic iron oxide particles in the presence basic catalyst in an aqueous medium to thereby obtain the spherical magnetic composite particles comprising the ferromagnetic iron oxide particles and a phenol resin as a cured product of the above compounds. If required, an acid aqueous solution comprising an acid having an acid dissociation constant pKa of 3 to 6 as an acid catalyst and a methylol melamine aqueous solution may be added to the aqueous medium comprising the spherical magnetic composite particles to form a coating layer formed of a melamine resin on the surface of the respective spherical magnetic composite particles.

First, the ferromagnetic iron oxide particles used in the present invention are described. The ferromagnetic iron oxide particles used in the present invention preferably have the following embodiments.

(1) The embodiment in which a total content of the ferromagnetic iron oxide particles in the spherical magnetic composite particles is 80 to 99% by weight; and the ferromagnetic iron oxide particles are constituted from ferromagnetic iron oxide particles (a) and ferromagnetic iron oxide particles (b) which are different in average particle diameter from each other (Invention 7).

(2) The embodiment in which the spherical magnetic composite particles further comprise dielectric particles having a relative dielectric constant of not less than 50 (Invention 8).

(2-1) The embodiment according to Invention 8 in which the ferromagnetic iron oxide particles consist of one kind of ferromagnetic iron oxide particles (b') solely; and a ratio of an average particle diameter (rc) of the dielectric particles to an average particle diameter (rb') of the ferromagnetic iron oxide particles (b') (rc/rb') is more than 1 (Invention 11).

(2-2) The embodiment according to Invention 8 in which the ferromagnetic iron oxide particles are constituted from two kinds of particles, i.e., ferromagnetic iron oxide particles (a") and ferromagnetic iron oxide particles (b") which are different in average particle diameter from each other; a ratio of an average particle diameter (ra") of the ferromagnetic iron oxide particles (a") to an average particle diameter (rb") of the ferromagnetic iron oxide particles (b") (ra"/rb") is more than 1; and a ratio of the average particle diameter (rc) of the dielectric particles to the average particle diameter (rb") of the ferromagnetic iron oxide particles (b") (rc/rb") is more than 1 (Invention 12).

First, the above embodiment (1) (Invention 7) is explained. The ferromagnetic iron oxide particles contained in the magnetic carrier according to the present invention are constituted from the ferromagnetic iron oxide particles (a) having a relatively large average particle diameter and the ferromagnetic iron oxide particles (b) having a relatively small average particle diameter. With this construction, a surface layer portion of the magnetic carrier is formed from the ferromagnetic iron oxide particles (a), whereas a core portion of the magnetic carrier is formed from the ferromagnetic iron oxide particles (b), so that irregularities are sufficiently formed on the surface of the magnetic carrier to thereby achieve a surface roughness as required. The ratio of an average particle diameter (ra) of the ferromagnetic iron oxide particles (a) having a relatively large average particle diameter to an average particle diameter (rb) of the ferromagnetic iron oxide particles (b) having a relatively small average particle diameter (ra/rb) is more than 1.0, preferably 1.1 to 10.0, more preferably 1.1 to 9.0 and especially preferably 1.2 to 5.0. When the magnetic carrier is constituted from the ferromagnetic iron oxide particles having the same average particle diameter, the resulting magnetic carrier may fail to have the surface layer portion formed of the ferromagnetic iron oxide particles (a), and therefore the irregularities tend to be hardly formed on the surface of the magnetic carrier to a sufficient extent, so that no sufficient adhesion to resin coating tends to be attained.

The content of the ferromagnetic iron oxide particles (a) contained in the magnetic carrier according to the present invention is preferably 1 to 50% by weight based on a total amount of the ferromagnetic iron oxide particles (a) and the ferromagnetic iron oxide particles (b). When the content of the ferromagnetic iron oxide particles (a) is less than 1 part by weight, the ferromagnetic iron oxide particles (b) forming the core portion of the magnetic carrier tends to be exposed onto the surface of the respective carrier particles, and therefore the surface layer portion formed of the ferromagnetic iron oxide particles (a) tends to be hardly formed, so that no sufficient number of irregularities tend to be formed on the surface of the magnetic carrier. When the content of the ferromagnetic iron oxide particles (a) is more than 50 part by weight, a whole amount of the ferromagnetic iron oxide particles (a) tend to be hardly incorporated into the magnetic carrier, and the non-incorporated to remain in the form of fine particles or other shaped particles, resulting in deteriorated yield of the magnetic carrier and failing to form a sufficient number of fine irregularities on the surface of the carrier particles. The content of the ferromagnetic iron oxide particles (a) is preferably 10 to 45 parts by weight.

The ferromagnetic iron oxide particles (a) used in the present invention preferably have an average particle diameter (ra) of 0.25 to 5.0 μm, and more preferably 0.25 to 2.0 μm. When the average particle diameter (ra) is less than 0.25 μm, a sufficient number of irregularities tend to be hardly formed on the surface of the magnetic carrier. When the average particle diameter (ra) is more than 5.0 μm, loads exerted onto protruded portions of the irregularities tend to be increased, so that the ferromagnetic iron oxide particles (a) tend to be desorbed, i.e., the irregularities tend to be removed, or a sufficient durability against coating resins tends to be hardly attained.

The ferromagnetic iron oxide particles (b) used in the present invention preferably have an average particle diameter (rb) of 0.05 to 0.25 μm. When the average particle diameter (rb) is less than 0.05 μm, the ferromagnetic iron oxide particles (b) tend to exhibit an excessively high agglomeration power, so that it may be difficult to produce the magnetic carrier. When the average particle diameter (ra) is more than 0.25 μm, no difference between particle diameters of the ferromagnetic iron oxide particles (a) and (b) tends to be present, so that it may be difficult to form a stable surface layer portion formed of the ferromagnetic iron oxide particles (a).

The ferromagnetic iron oxide particles (a) and the ferromagnetic iron oxide particles (b) both are in the form of magnetic iron oxide particles such as magnetite particles and maghemite particles. The ferromagnetic iron oxide particles (a) and the ferromagnetic iron oxide particles (b) may respectively have any particle shape selected from the group consisting of a spherical shape, a hexahedral shape, an octahedral shape, a polyhedral shape and an amorphous shape. Further, combination of these shapes may also be used. In this case, the particles may be used in combination with those particles having either the same shape or a different other shape.

Next, the above embodiment (2) (Invention 8) is explained. In the embodiment (2), the magnetic carrier comprises dielectric particles having a relative dielectric constant of not less than 50. The dielectric particles having a relative dielectric constant of not less than 50 mean particles whose relative dielectric constant is not less than 50, preferably not less than 70 and more preferably not less than 80 as measured by the below-mentioned evaluation method. Examples of the suitable dielectric particles include titanium oxide particles, titanate particles and zirconate particles. Specific examples of the dielectric particles include barium titanate particles, strontium titanate particles, potassium titanate particles, magnesium titanate particles, lead titanate particles, titanium dioxide particles, barium zirconate particles, calcium zirconate particles and lead zirconate particles. These dielectric particles may be used alone or in combination of any two or more thereof.

The dielectric particles preferably have an average particle diameter (rc) of 0.25 to 5.0 μm, and more preferably 0.25 to 4.5 μm. When the average particle diameter (rc) is less than 0.25 μm, a sufficient number of irregularities tend to be hardly formed on the surface of the magnetic carrier. When the average particle diameter (rc) is more than 5.0 μm, loads exerted onto protruded portions of the irregularities tend to be increased, so that the ferromagnetic iron oxide particles (a) tend to be desorbed, i.e., the irregularities tend to be removed, or a sufficient durability against coating resins tends to be hardly attained.

With respect to the ferromagnetic iron oxide particles used in combination with the dielectric particles, there are present two embodiments, i.e., the embodiment (2-1) in which the ferromagnetic iron oxide particles are constituted from the ferromagnetic iron oxide particles (b') solely, and the ratio of the average particle diameter (rc) of the dielectric particles to the average particle diameter (rb') of the ferromagnetic iron oxide particles (b') (rc/rb') is more than 1 (Invention 11), and the embodiment (2-2) in which the ferromagnetic iron oxide particles are constituted from ferromagnetic iron oxide particles (a") and ferromagnetic iron oxide particles (b") which are different in average particle diameter from each other; a ratio of an average particle diameter (ra") of the ferromagnetic iron oxide particles (a") to an average particle diameter (rb") of the ferromagnetic iron oxide particles (b") (ra"/rb") is more than 1; and a ratio of the average particle diameter (rc) of the dielectric particles to the average particle diameter (rb") of the ferromagnetic iron oxide particles (b") (rc/rb") is more than 1 (Invention 12).

The above ferromagnetic iron oxide particles (a") and the above ferromagnetic iron oxide particles (b') and ferromagnetic iron oxide particles (b") are basically the same as the above ferromagnetic iron oxide particles (a) and the above ferromagnetic iron oxide particles (b), respectively, except that they are different in particle diameter only from the ferromagnetic iron oxide particles (a) and the ferromagnetic iron oxide particles (b), respectively.

When the ferromagnetic iron oxide particles are constituted from the ferromagnetic iron oxide particles (b') solely, the ratio of the average particle diameter (rc) of the dielectric particles to the average particle diameter (rb') of the ferromagnetic iron oxide particles (b') (rc/rb') is more than 1, preferably 1.1 to 10.0, more preferably 1.2 to 9.0, and especially preferably 1.3 to 5.0. When the average particle diameter of the ferromagnetic iron oxide particles (b') is larger than the average particle diameter (rc) of the dielectric particles, the dielectric particles may fail to form the surface layer portion, and therefore a sufficient number of irregularities tend to be formed, so that no sufficient adhesion to coating resins tends to be attained.

When the ferromagnetic iron oxide particles are constituted from two kinds of ferromagnetic iron oxide particles, i.e., ferromagnetic iron oxide particles (a") and ferromagnetic iron oxide particles (b") which are different in average particle diameter from each other, the ratio of an average particle diameter (ra") of the ferromagnetic iron oxide particles (a") to an average particle diameter (rb") of the ferromagnetic iron oxide particles (b") (ra"/rb") is more than 1, preferably 1.1 to 10.0, more preferably 1.2 to 9.0, and especially preferably 1.3 to 5.0. The ratio of the average particle diameter (rc) of the dielectric particles to the average particle diameter (rb") of the ferromagnetic iron oxide particles (b") (rc/rb") is more than 1, preferably 1.1 to 10.0, more preferably 1.2 to 9.0, and especially preferably 1.3 to 5.0. The case where the average particle diameters (ra") and (rb") are equal to each other, is the same as the case where the ferromagnetic iron oxide particles are constituted from the ferromagnetic iron oxide particles (b') solely. It is required that the average particle diameter (rb") is smaller than the average particle diameter (ra") and the average particle diameter (rc). The average particle diameter (ra") and the average particle diameter (rc) may be either substantially the same or different from each other as long as the above relational formulae of (ra"/rb") and (rc/rb") can be respectively satisfied. As a result, the surface layer portion can be formed of a mixture of the dielectric particles and the ferromagnetic iron oxide particles (a"), and the core portion can be formed of the ferromagnetic iron oxide particles (b") having a smaller particle diameter, whereby a sufficient number of irregularities can be formed on the surface layer portion.

The content of the ferromagnetic iron oxide particles (a") is preferably less than 49% by weight and more preferably 10 to 45% by weight based on a total amount of the ferromagnetic iron oxide particles (a"), the ferromagnetic iron oxide particles (b") and the dielectric particles. When the content of the ferromagnetic iron oxide particles (a") is not less than 49 parts by weight, a whole amount of the ferromagnetic iron oxide particles (a") tend to be hardly incorporated into the magnetic carrier, and the non-incorporated particles tend to remain in the form of fine particles or other shaped particles, resulting in deteriorated yield of the magnetic carrier and failing to form fine irregularities on the surface of the carrier particles.

The total content of the dielectric particles and the ferromagnetic iron oxide particles in the spherical magnetic composite particles is preferably 80 to 99% by weight, and more preferably 85 to 98% by weight. When the total content of the dielectric particles and the ferromagnetic iron oxide particles is less than 80% by weight, the resin content in the spherical magnetic composite particles tends to be comparatively large, so that the large particles tend to be produced. When the total content of the dielectric particles and the ferromagnetic iron oxide particles is more than 99% by weight, the resin content tends to become excessively small, resulting in poor strength of the obtained particles.

The content of the dielectric particles in the spherical magnetic composite particles is preferably 1 to 50% by weight and more preferably 10 to 45% by weight based on the total amount of the ferromagnetic iron oxide particles and the dielectric particles. When the content of the dielectric particles is less than 1% by weight, the ferromagnetic iron oxide particles (b) forming the core portion of the magnetic carrier tends to be exposed onto the surface thereof, so that the surface layer portion tends to be hardly formed from the ferromagnetic iron oxide particles (a), thereby failing to obtain a sufficient number of irregularities on the surface of the particles. When the content of the dielectric particles is more than 50% by weight, a whole amount of the ferromagnetic iron oxide particles (a) tend to be hardly incorporated into the magnetic carrier, and the non-incorporated particles tend to remain in the form of fine particles or other shaped particles, resulting in deteriorated yield of the magnetic carrier and failing to form a sufficient number of fine irregularities on the surface of the carrier particles.

The ferromagnetic iron oxide particles (a) (hereinafter intended to also include the particles (a")) and the ferromagnetic iron oxide particles (b) (hereinafter intended to also include the particles (b') and (b")) may be coated with a compound of at least one element selected from the group consisting of Al, Mg, Mn, Zn, Ni, Cu, Ti and Si. When coating the ferromagnetic iron oxide particles with the above compound, the amount of the coating element being present on the surface of the ferromagnetic iron oxide particles is preferably 0.35 to 4.0% by weight and more preferably 0.4 to 3.5% by weight based on the total amount of the ferromagnetic iron oxide particles. When using the ferromagnetic iron oxide particles whose surface is coated with the compound of at least one element selected from the group consisting of Al, Mg, Mn, Zn, Ni, Cu, Ti and Si, it is possible to readily obtain a magnetic carrier having a high electric resistance value.

The ferromagnetic iron oxide particles whose surface is coated with the compound of at least one element selected from the group consisting of Al, Mg, Mn, Zn, Ni, Cu, Ti and Si may be obtained by the following production process.

The surface-coated ferromagnetic iron oxide particles used in the present invention may be produced as follows. That is, magnetite core particles are produced by an ordinary method, and then a slurry comprising the core particles is maintained in a temperature range of 70 to 95° C. After suitably adjusting a pH value of the slurry, a coating element salt is added to the slurry in an amount of not more than 0.015% by weight based on the weight of the core particles. The resulting slurry is aged for 30 min or longer, and then controlled in pH thereof, and further subjected to water-washing and drying by ordinary methods, thereby obtaining the ferromagnetic iron oxide particles as aimed.

The core particles used for obtaining the surface-coated ferromagnetic iron oxide particles used in the present invention may be selected from those particles having various shapes and particle diameters from the standpoints of magnetic properties, dispersibility, etc., as required, and may be produced by various methods. In order to effectively achieve the objects of the present invention, from the standpoint of uniformly performing a surface treatment, the slurry containing the core particles preferably comprise none of substances which tend to prohibit the surface treatment, such as, for example, unreacted iron hydroxide fine particles.

Thus, the slurry containing the core particles can be obtained by various methods. For example, by controlling the pH value of a ferrous ($Fe^{2+}$) aqueous solution during an oxidation reaction thereof to a predetermined suitable value, there can be obtained the core particles having an octahedral shape, a polyhedral shape, a hexahedral shape, a spherical shape or an irregular shape. In addition, by suitably adjusting conditions for particle growth during the oxidation reaction, there can be obtained the core particles having a desired particle diameter. Further, the core particles having a well-controlled surface smoothness can be produced by suitably controlling the conditions for particle growth at an end stage of the oxidation reaction or by adding a silica component, an aluminum component or a calcium component, or components which tend to form a spinel ferrite structure, such as zinc and magnesium, to the slurry, as generally known in the art.

As to the ferrous ($Fe^{2+}$) aqueous solution, there may be used, for example, aqueous solutions of ordinary ion compounds such as ferrous sulfate and ferrous chloride. In addition, as the alkali solution which is used for obtaining the iron hydroxide or serves as a pH modifier, there may be used aqueous solutions of sodium hydroxide, sodium carbonate, etc. The respective raw materials may be appropriately selected in view of economy or reaction efficiency.

The pH of the slurry used in surface treatment with Al is preferably 8.0 to 9.0 and more preferably 8.2 to 8.8. When the pH of the slurry is less than 8.0, the Al component may fail to form a coating layer on the surface of the respective core particles, and tends to be precipitated by itself in the form of an Al compound, so that the resulting particles tend to undesirably exhibit a low electric resistance value, a high BET specific surface area value and a high moisture absorption. When the pH of the slurry is more than 9.0, the Al component may also fail to form a coating layer on the surface of the respective core particles, and tends to be precipitated by itself in the form of an Al compound, so that the resulting particles tend to undesirably exhibit a low electric resistance value, a high BET specific surface area value and a high moisture absorption. The pH of the slurry used in surface treatment with Mg is preferably 9.5 to 10.5; the pH of the slurry used in surface treatment with Mn is preferably 8.0 to 9.0; the pH of the slurry used in surface treatment with Zn is preferably 8.0 to 9.0; the pH of the slurry used in surface treatment with Ni is preferably 7.5 to 8.5; the pH of the slurry used in surface treatment with Cu is preferably 6.5 to 7.5; the pH of the slurry used in surface treatment with Ti is preferably 8.0 to 9.0; and the pH of the slurry used in surface treatment with Si is preferably 6.5 to 7.5. When the pH of the slurry used in surface treatment with the respective elements is out of the above-specified range, the resulting particles tend to undesirably exhibit a low electric resistance value and a high moisture absorption.

The temperature of the slurry used for the surface treatment with the coating component is preferably 70 to 95° C. When the temperature of the slurry is less than 70° C., the resulting particles tend to undesirably exhibit a high BET specific surface area value, and the slurry temperature less than 70° C. also tends to be undesirable from the viewpoint of moisture absorption of the ferromagnetic iron oxide particles themselves. The upper limit of the temperature of the slurry is not particularly limited. However, since the slurry is in the form of an aqueous slurry, the upper limit of the temperature of the slurry is about 95° C. in view of a good productivity and low costs.

The velocity of addition of the coating compound to the slurry comprising the core particles is preferably not more than 0.015% by weight/min and more preferably not more than 0.01% by weight in terms of the coating element based on the weight of the core particles. When the velocity of addition of the coating compound to the slurry is more than 0.015% by weight in terms of the coating element, the coating compound may fail to form a coating layer on the surface of the respective core particles, and tends to be precipitated by itself, so that the resulting ferromagnetic iron oxide particles by themselves tend to exhibit a low electric resistance value, a high BET specific surface area value and a high moisture absorption. The lower limit of the velocity of addition of the coating compound to the slurry is not particularly limited, and is 0.002% by weight in view of a productivity thereof.

After adding the coating compound, the resulting slurry is preferably aged for 30 min or longer to uniformly treat the surface of the respective core particles with the coating compound. The upper limit of the aging time of the slurry is not particularly limited, and is about 240 min in view of productivity thereof. In addition, the slurry is preferably intimately stirred.

After being aged, the pH of the slurry is preferably controlled to the range of 4.0 to 10.0 and more preferably 6.0 to 8.0. When the pH of the slurry is less than 4.0, it may be difficult to form a uniform coating compound layer on the surface of the respective core particles. When the pH of the slurry is more than 10.0, it may also be difficult to form a uniform coating compound layer on the surface of the respective core particles. Upon controlling the pH, the slurry is preferably intimately stirred.

After completion of the reaction, the resultant particles may be subjected to water-washing and drying by ordinary methods.

The surface of the respective ferromagnetic iron oxide particles (a), ferromagnetic iron oxide particles (b) and dielectric particles used in the present invention is preferably previously subjected to lipophilic treatment. With such a lipophilic treatment, it is possible to more readily obtain a magnetic carrier having a spherical shape.

The lipophilic treatment may be suitably performed by the method of treating the ferromagnetic iron oxide particles (a), ferromagnetic iron oxide particles (b) and dielectric particles with a coupling agent such as a silane coupling agent or a titanate coupling agent, or the method of dispersing the ferromagnetic iron oxide particles in an aqueous medium comprising a surfactant to allow the particles to adsorb the surfactant thereon.

Examples of the silane coupling agent include those having a hydrophobic group, an amino group or an epoxy group. Specific examples of the silane coupling agent having a hydrophobic group include vinyl trichlorosilane, vinyl triethoxysilane and vinyl-tris(β-methoxy) silane. As the silane coupling agent having an amino group or an epoxy group, there may be respectively used the above amino group-containing silane coupling agents and the above epoxy group-containing silane coupling agents.

As the titanate coupling agent, there may be used isopropyl triisostearoyl titanate, isopropyl tridecylbenzenesulfonyl titanate, isopropyl tris(dioctylpyrophosphate) titanate or the like.

As the surfactant, there may be used commercially available surfactants. Among these surfactants, those surfactants having a functional group capable of bonding to a hydroxyl group in the ferromagnetic iron oxide particles or on the surface thereof are suitably used, and the ionicity of the surfactants is preferably cationic or anionic.

Although the objects of the present invention can be achieved by using any of the above lipophilic treatments, from the viewpoint of good adhesion to the phenol resin, the treatments with the silane coupling agent having an amino group or an epoxy group are preferred.

The treating amount of the above coupling agent or surfactant is preferably 0.1 to 10% by weight based on the weight of the ferromagnetic iron oxide particles (a) and ferromagnetic iron oxide particles (b) to be treated.

The respective ferromagnetic iron oxide particles (a), ferromagnetic iron oxide particles (b) and dielectric particles may be previously mixed together before subjected to the lipophilic treatment, or may be separately subjected to the lipophilic treatment. However, it is essentially required that the ferromagnetic iron oxide particles (a), ferromagnetic iron oxide particles (b) and dielectric particles are reacted in an intimately mixed condition (the ferromagnetic iron oxide particles (a), ferromagnetic iron oxide particles (b) and dielectric particles kept in the intimately mixed condition are hereinafter referred to as "blended particles").

The process for producing the spherical magnetic composite particles comprising the blended particles and a phenol resin according to the present invention is as follows.

Examples of the phenol compound used in the present invention include compounds having a phenolic hydroxyl group, e.g., phenol; alkyl phenols such as m-cresol, p-cresol, p-tert-butyl phenol and o-propyl phenol; and halogenated phenols obtained by replacing a part or whole of alkyl groups of the above compounds with a chlorine atom or a bromine atom.

The total content of the blended particles in the spherical magnetic composite particles is preferably 80 to 99% by weight based on the weight of the spherical magnetic composite particles. When the content of the blended particles is less than 80% by weight, the resin content in the spherical magnetic composite particles tends to be comparatively large, so that the large particles tend to be produced. When the content of the blended particles is more than 99% by weight, the resin content tends to be comparatively insufficient, resulting in poor strength of the obtained particles. The content of the blended particles in the spherical magnetic composite particles is more preferably 85 to 99% by weight.

Examples of the aldehyde compound used in the present invention include formaldehyde which may be in the form of either formalin or para-aldehyde, acetaldehyde, furfural, glyoxal, acrolein, crotonaldehyde, salicylaldehyde and glutaraldehyde. Among these aldehyde compounds, most preferred is formaldehyde.

The molar ratio of the aldehyde compound to the phenol compound is preferably 1.0 to 4.0. When the molar ratio of the aldehyde compound to the phenol compound is less than 1.0, it may be difficult to produce the aimed particles, or since curing of the resin hardly proceeds, there is a tendency that the obtained particles have a low strength. When the molar ratio of the aldehyde compound to the phenol compound is more than 4.0, there is a tendency that the amount of unreacted aldehyde compound remaining in the aqueous medium after the reaction is increased. The molar ratio of the aldehyde compound to the phenol compound is more preferably 1.2 to 3.0.

As the basic catalyst used in the present invention, there may be mentioned those basic catalysts ordinarily used for production of resol resins. Examples of the basic catalyst include aqueous ammonia, and alkyl amines such as hexamethylenetetramine, dimethyl amine, diethyl amine and polyethylene amine. Among these basic catalysts, especially preferred is aqueous ammonia. The molar ratio of the basic catalyst to the phenol compound is preferably 0.05 to 1.50. When the molar ratio of the basic catalyst to the phenol compound is less than 0.05, curing of the resin tends to hardly proceed sufficiently, so that it may be difficult to granulate the particles. When the molar ratio of the basic catalyst to the phenol compound is more than 1.50, the structure of the phenol resin tends to be adversely affected, resulting in deteriorated granulation of the particles, so that it may be difficult to obtain particles having a large particle diameter.

In the present invention, the reaction may be carried out in the aqueous medium. The concentration of solid components in the aqueous medium is preferably controlled to 30 to 95% by weight and more preferably 60 to 90% by weight.

The reaction solution to which the basic catalyst is added is heated to the temperature range of 60 to 95° C., and reacted at that temperature for 30 to 300 min, preferably 60 to 240 min, to subject the resulting phenol resin to polycondensation reaction for curing thereof.

In the above reaction, in order to obtain spherical magnetic composite particles having a high sphericity, the reaction temperature is preferably gradually increased. The temperature rise rate is preferably 0.3 to 1.5° C./min and more preferably 0.5 to 1.2° C./min.

Also, in the above reaction, in order to well control the particle size of the obtained particles, the stirring speed of the reaction solution is suitably adjusted. The stirring speed is preferably 100 to 1000 rpm.

After completion of curing the resin, the reaction product is cooled to a temperature of not more than 40° C., so that the structural bodies obtained by bonding the blended particles through the phenol resin as a binder are dispersed in the aqueous medium, thereby obtaining a water dispersion of the spherical magnetic composite particles having a surface layer portion formed of the ferromagnetic iron oxide particles (a).

The thus obtained water dispersion of the spherical magnetic composite particles is subjected to solid-liquid separation by ordinary methods such as filtration and centrifugal separation, and then the obtained solids are washed and dried, thereby obtaining the aimed spherical magnetic composite particles.

The spherical magnetic composite particles used in the present invention may be further provided on the surface thereof with a coating layer formed of a melamine resin. The reaction for forming the coating layer formed of a melamine resin may be continuously carried out in the aqueous medium in which the spherical magnetic composite particles have been produced. That is, while maintaining the reaction solution in a temperature range of 60 to 95° C., an acid aqueous solution comprising an acid having an acid dissociation constant pKa of 3 to 6 as an acid catalyst and a methylol melamine aqueous solution prepared by reacting melamine and an aldehyde compound with each other in the presence of water are added to the reaction solution to react therewith for 30 to 300 min and preferably 60 to 240 min while stirring, so that a cured melamine resin is formed on the surface of the respective spherical magnetic composite particles.

At this time, in order to form a thin uniform coating layer formed of the melamine resin on the surface of the respective spherical magnetic composite particles, the reaction temperature and the treating time are preferably controlled according to the amount of melamine added and the concentration of the acid aqueous solution.

At this time, in order to form a thin uniform coating layer of the melamine resin on the surface of the respective spherical magnetic composite particles, the stirring speed is preferably controlled. The stirring speed is preferably 100 to 1000 rpm.

When the cured product is cooled to a temperature of not higher than 40° C., the blended particles are dispersed in the binder resin to thereby obtain a water dispersion of the spherical magnetic composite particles having such a structure in which a surface layer portion comprising the ferromagnetic iron oxide particles (a) and/or the dielectric particles is formed on the surface of the respective particles, and further the thin uniform melamine resin coating layer is formed on the surface layer portion.

The thus obtained water dispersion of the spherical magnetic composite particles is subjected to solid-liquid separation by ordinary methods filtration and centrifugal separation, and then the obtained solids are washed and dried, thereby obtaining the spherical magnetic composite particles as aimed.

In the above method of adding melamine to the aqueous medium comprising the spherical magnetic composite particles, if the water-insoluble melamine is directly added in a solid state to the aqueous medium, a melamine resin coating layer formed on the surface of the respective spherical magnetic composite particles tends to become non-uniform, so that the resulting coated spherical magnetic composite particles exhibit an undesirably large voltage dependency.

In the above method of adding melamine to the aqueous medium comprising the spherical magnetic composite particles, it is preferred that the melamine is added in the form of a methylol melamine aqueous solution separately prepared by reacting melamine and an aldehyde compound in water. When the methylolation reaction rapidly proceeds in the aqueous solution, the aqueous solution tends to become whitely turbid owing to polycondensation reaction of methylol melamine, so that it may be difficult to form the thin uniform melamine resin coating layer on the surface of the respective spherical magnetic composite particles. Therefore, the methylol melamine aqueous solution in the form of a transparent aqueous solution in which the polymerization is allowed to proceed to a certain extent is preferably added to the aqueous medium comprising the spherical magnetic composite particles.

Since the melamine resin has a positive charging property, the magnetic carrier can be enhanced in a positive charging property by forming the melamine resin coating layer thereon.

Since the melamine resin is capable of forming a hard film, the magnetic carrier can also be enhanced in durability.

The amount of the melamine added to the spherical magnetic composite particles is preferably 0.1 to 5.0% by weight. When the amount of the melamine added is less than 0.1% by weight, it may be difficult to coat the particles therewith to a sufficient extent, and the electric resistance value of the obtained coated spherical magnetic composite particles tend to have a large voltage dependency in some cases. On the other hand, when the amount of the melamine added is more than 5.0% by weight, the electric resistance value of the obtained coated particles tends to be excessively high.

The aldehyde compound used for forming the melamine coating layer may be selected from those which are usable in the reaction for production of the above spherical magnetic composite particles.

The molar ratio of the aldehyde compound to melamine in the methylol melamine aqueous solution is preferably 1 to 10, and the concentration of melamine in the methylol melamine aqueous solution is preferably 5 to 50% by weight.

The methylol melamine aqueous solution may be prepared as follows. That is, melamine and the aldehyde compound are added to water to obtain a reaction solution, and the reaction solution is heated to a temperature of 40 to 80° C. while stirring. The reaction solution is subjected to methylolation reaction in the above temperature range for 30 to 240 min, preferably for 60 to 180 min to produce the methylol melamine aqueous solution.

In the above reaction, the temperature rise rate is preferably 0.5 to 1.5° C./min, and the stirring speed is preferably 100 to 1000 rpm.

In the present invention, as the acid catalyst, there may be suitably used a weak acid having an acid dissociation constant pKa of 3 to 6. Examples of the weak acid include formic acid, oxalic acid and acetic acid. Among these acids, most preferred is acetic acid. The content of the acid in the aqueous medium used for forming the spherical magnetic composite particles is preferably 0.5 to 3% by weight.

The present invention is characterized in that the acid aqueous solution comprising the acid having an acid dissociation constant pKa of 3 to 6 as an acid catalyst, and the methylol melamine aqueous solution, are added to the aqueous medium comprising the above spherical magnetic composite particles. That is, by adding both the aqueous solutions to the aqueous medium, the reaction and curing speed of methylol melamine become optimum, so that it is possible to form a thin uniform melamine resin coating layer on the surface of the respective spherical magnetic composite particles comprising the ferromagnetic iron oxide particles and the cured phenol resin. As a result, the obtained spherical magnetic composite particles can have a less voltage dependency of electric resistance value and an adequate electric resistance value and therefore are capable of maintaining a proper electric resistance value upon the development.

When using an acid catalyst generating a strong acid having an acid dissociation constant pKa of less than 3 such as, for example, ammonium chloride generating hydrochloric acid, it may be difficult to form the uniform melamine resin coating layer, so that the electric resistance value of the resulting spherical magnetic composite particles tends to have an undesirably large voltage dependency. In addition, when the acid dissociation constant pKa of the acid catalyst is more than 6, it may be difficult to form the melamine resin coating layer to a sufficient extent.

The surface of the magnetic carrier for an electrophotographic developer according to the present invention may also be coated with at least one resin selected from the group consisting of polyolefin-based resins, polyvinyl-based resins, polyvinylidene-based resins, silicone-based resins, fluorine-based resins, amino-based resins, acrylic resins and styrene-acryl-based resins.

The coating resins used in the present invention are not particularly limited. Examples of the coating resins include polyolefin-based resins such as polyethylene and polypropylene; polystyrene; acrylic resins; polyacrylonitrile; polyvinyl-based or polyvinylidene-based resins such as polyvinyl acetate, polyvinyl alcohol, polyvinyl butyral, polyvinyl chloride, polyvinyl carbazole, polyvinyl ether and polyvinyl ketone; vinyl chloride/vinyl acetate copolymers and styrene/acrylic acid copolymers; straight silicone-based resins having an organosiloxane bond and modified products thereof; fluorine-based resins such as polytetrafluoroethylene, polyvinyl fluoride, polyvinylidene fluoride and polychlorotrifluoroethylene; polyesters; polyurethanes; polycarbonates; amino-based resins such as urea/formaldehyde resins; epoxy-based resins; polyamide resins; polyimide resins; polyamide imide resins; fluorine-containing polyamide resins; fluorine-containing polyimide resins; and fluorine-containing polyamide imide resins. Among these coating resins, preferred is at least one resin selected from the group consisting of silicone-based resins, fluorine-based resins, acrylic resins and styrene-acryl-based resins. When coating the surface of the magnetic carrier particles with the silicone-based resins or the fluorine-based resins which have a low surface energy, it is possible to suppress occurrence of spent toner. In addition, when coated with the acrylic resins or the styrene-acryl-based resins, the effect of enhancing adhesion to the spherical magnetic composite particles as well as a charging property of the resulting magnetic carrier can be attained.

Examples of the preferred silicone-based resin include condensation reaction-type silicone resins. Examples of the preferred fluorine-based resins include polyfluorinated acrylate resins, polyfluorinated methacrylate resins, polyfluorinated vinylidene resins, polytetrafluoroethylene resins, polyhexafluoropropylene resins and combination of these resins.

Examples of the acrylic resins include copolymers obtained by copolymerizing an alkyl acrylate such as methyl methacrylate, methyl ethacrylate, ethyl methacrylate, butyl methacrylate, lauryl methacrylate, stearyl methacrylate and behenyl methacrylate, a cycloalkyl acrylate such as cyclopentyl methacrylate and cyclohexyl methacrylate, or an aromatic acrylate such as phenyl acrylate, with acrylic acid, copolymers obtained by copolymerizing the above acrylates with an epoxy compound such as glycidyl methacrylate, and copolymers obtained by copolymerizing the above acrylates with an alcohol-based compound such as glycerol monomethacrylate and 2-hydroxyethyl methacrylate. In view of less environmental dependency or the like of the resulting magnetic carrier, among these acrylic resins, preferred are those produced using short-chain alkyl acrylates such as methyl methacrylate and ethyl ethacrylate.

Examples of the styrene-acryl-based resins include copolymers of the above acrylic monomers with styrene-based monomers. In view of a less difference in charge amount between under high-temperature and high-humidity conditions and under low-temperature and low-humidity conditions, preferred styrene-acryl-based resins are copolymers of styrene with short-chain alkyl methacrylates.

The coating amount of the resin on the magnetic carrier of the present invention is preferably 0.1 to 5.0% by weight based on the weight of the spherical magnetic composite particles. When the coating amount of the resin is less than 0.1% by weight, it may be difficult to sufficiently coat the particles with the resin, resulting in unevenness of the obtained resin coat. When the coating amount of the resin is more than 5.0% by weight, although the resin coat can adhere onto the surface of the respective spherical magnetic composite particles, the thus produced spherical magnetic composite particles tend to be agglomerated together, so that it may be difficult to well control the particle size of the spherical magnetic composite particles. The coating amount of the resin on the magnetic carrier is more preferably 0.5 to 3.0% by weight.

In the present invention, the resin coating layer may also comprise fine particles. Examples of the suitable fine particles include those fine particles capable of imparting a negative charging property to a toner such as fine particles of quaternary ammonium salt-based compounds, triphenylmethane-based compounds, imidazole-based compounds, nigrosine-based dyes, polyamine resins, etc., and those fine particles capable of imparting a positive charging property to a toner such as fine particles of dyes comprising metals such as Cr and Co, salicylic acid metal salt compounds, alkyl salicylic acid metal salt compounds, etc. These fine particles may be used singly or in combination f any two or more thereof.

Also, in the present invention, the resin coating layer may also comprise conductive fine particles. It is advantageous to incorporate the conductive fine particles into the resin, because the resulting magnetic carrier can be readily controlled in resistance thereof. As the conductive fine particles, there may be used conventionally known fine particles. Examples of the conductive fine particles include fine particles of carbon blacks such as acetylene black, channel black, furnace black and koechen black; carbides of metals such as Si and Ti; nitrides of metals such as B and Ti; and borates of metals such as Mo And Cr. These conductive fine particles may be used singly or in combination of any two or more thereof. Among these conductive fine particles, preferred are fine particles of carbon blacks.

When coating the surface of the respective spherical magnetic composite particles with the resin, there may be used various known coating methods. Examples of the coating methods include a drying method, a fluidized bed method, a spray drying method, a rotary drying method, and a dip-drying method using a universal stirrer and a Henschel mixer, a high-speed mixer, etc.

Next, the two-component system developer of the present invention is described.

As the toner used in combination with the magnetic carrier for an electrophotographic developer according to the present invention, there may be mentioned any conventionally known toners. More specifically, there may be used those toners comprising a binder resin and a colorant as main components together with a release agent, a magnetic material, a fluidizing agent, etc., which may be added to the main components, if required. Also, the toners may be produced by known methods.

<Functions>

The important point of the present invention resides in that by using the spherical magnetic composite particles obtained by dispersing the two kinds of ferromagnetic iron oxide particles which are different in particle diameter from each other in the phenol resin, whose surface layer portion is formed of the ferromagnetic iron oxide particles (a) having a larger particle diameter to thereby form and control fine irregularities (surface roughness, distance between the irregularities, height of the irregularities and shape of the irregularities) on the surface of the particles, and further by using the ferromagnetic iron oxide particles having an adequate electric resistance value with a less voltage dependency, it is possible to produce a magnetic carrier for an electrophotographic developer which has a sufficient electric resistance value and a less voltage dependency of the electric resistance value. Further, by forming a thin uniform melamine resin coating layer on the surface of the respective particles, it becomes possible to reduce a voltage dependency of electric resistance value of the magnetic carrier while allow the magnetic carrier to exhibit an adequate electric resistance value. As a result, it is possible to maintain an appropriate electric resistance value upon the development, reproduce high-density uniform solid images, and keep high-quality images having an excellent gradation for a long period of time.

In the process for producing the magnetic carrier for an electrophotographic developer according to the present invention, the ferromagnetic iron oxide particles (a) having a relatively large average particle diameter and the ferromagnetic iron oxide particles (b) having a relatively small average particle diameter are used, and the content of the ferromagnetic iron oxide particles (a) is controlled to 1 to 50% by weight based on the total amount of the ferromagnetic iron oxide particles (a) and the ferromagnetic iron oxide particles (b). Therefore, when forming composite particles using the phenol resin as a binder, it is possible to stably obtain the spherical magnetic composite particles having a surface layer portion formed of the ferromagnetic iron oxide particles (a), so that fine irregularities are formed according to the particle diameter and shape of the ferromagnetic iron oxide particles (a) used for forming the surface layer portion. Furthermore, by adding an acid aqueous solution comprising an acid having an acid dissociation constant pKa of 3 to 6 as an acid catalyst and a methylol melamine aqueous solution to the aqueous medium comprising the spherical magnetic composite particles, it is possible to form a thinner and more uniform melamine resin coating layer on the surface of the respective spherical magnetic composite particles.

Figure 5:
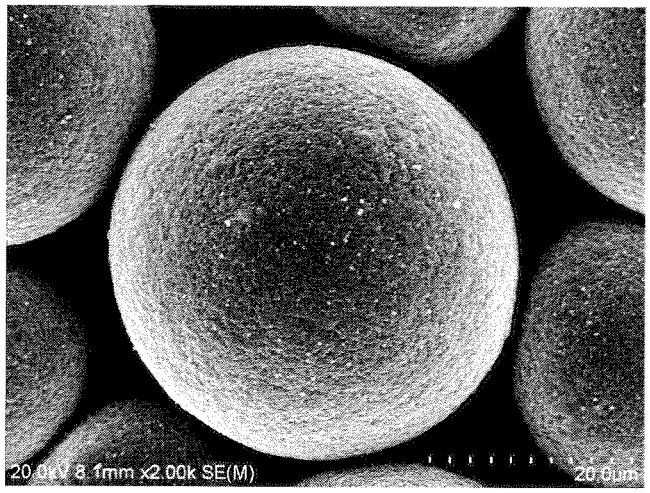
FIG. 5 is an electron micrograph showing a particle structure of spherical magnetic composite particles obtained in Comparative Example 1-1 (magnification: ×2000).
Figure 6:
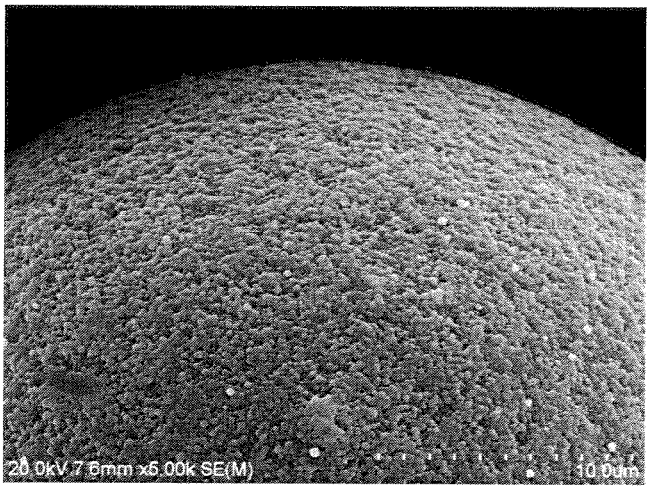
FIG. 6 is an electron micrograph showing a surface structure of spherical magnetic composite particles obtained in Comparative Example 1-1 (magnification: ×5000).

As shown in SEM micrographs of FIGS. 1 to 4, the magnetic carrier according to the present invention is characterized in that the surface layer portion thereof has fine irregularities owing to the particle diameter and shape of the ferromagnetic iron oxide particles having a larger average particle diameter. That is, as shown in SEM micrographs of FIGS. 5 and 6, the surface of respective particles of the magnetic carrier according to the present invention is apparently different from an even and smooth particle surface of the conventional magnetic carriers. Meanwhile, in the below-mentioned Examples, it was confirmed that the particle diameter of the ferromagnetic iron oxide particles which was determined from the shape of the surface portion of the magnetic carrier shown in these SEM micrographs was consistent with that of the ferromagnetic iron oxide particles (a) having a larger average particle diameter.

The reason why in the magnetic carrier according to the present invention, the surface layer portion thereof is formed of the ferromagnetic iron oxide particles (a) having a relatively large average particle diameter, and the core portion thereof is formed of the ferromagnetic iron oxide particles (b) having a relatively small average particle diameter, is considered as follows although it is not clearly determined yet. That is, the ferromagnetic iron oxide particles (b) having a relatively small average particle diameter have a larger surface area per unit volume (weight) of particles as compared to the ferromagnetic iron oxide particles (a) having a relatively large average particle diameter. Therefore, in the case where agglomerated particles have a smaller surface contact energy relative to a solvent and an additive such as a binder and therefore exhibit a more stable energy condition, the agglomerated particles obtained by agglomeration of the particles having a larger surface area can have a much less surface contact energy relative to the solvent or the additive and exhibit a much more stable energy condition. For this reason, the ferromagnetic iron oxide particles (b) having a relatively small average particle diameter are agglomerated in advance to form the core portion, and then the ferromagnetic iron oxide particles (a) having a relatively large average particle diameter are agglomerated to cover the core portion. That is, it is considered that the particles are formed into the structure having a smallest surface energy condition.

As a result, the obtained magnetic carrier can be considerably enhanced in adhesion to resins upon coating with the resins, is excellent in durability against peeling-off or abrasion of a coating layer, exhibit a good stability to mechanical stress exerted on the carrier, and can be stably maintained for a long period of time without occurrence of spent toner and fogging and unevenness in image density. In addition, by controlling an electric resistance of the magnetic carrier, it is possible to obtain images having an excellent gradation. Further, since a thin uniform melamine resin coating layer is formed on the surface of the respective particles, it is possible to adequately control an electric resistance value of the resulting spherical magnetic composite particles and reduce a voltage dependency of the electric resistance value. Thus, it is possible to readily design electric resistance characteristics and a charging property of the magnetic carrier obtained by forming a coating resin on the surface of the respective spherical magnetic composite particles.

Furthermore, in the present invention, since the magnetic carrier comprises a dielectric material, it is possible to independently control a dielectric property of the carrier. Therefore, the carrier can be enhanced in charging stability, so that the resulting toner can be stabilized in charge amount irrespective of variation of environmental conditions such as humidity, resulting in stable density of the obtained toner images. In addition, the printed images can be enhanced in image quality to thereby obtain stable developing properties for a long period of time.

EXAMPLES

The present invention is described in more detail by the following typical Examples. However, these Examples are only illustrative and not intended to limit the present invention thereto. In the followings, Examples 2-1 to 2-12 and Comparative Examples 2-1 to 2-6 relate to Inventions 5 and 16 in which the melamine resin coating layer was formed on the respective particles; and Examples 3-1 to 3-8 and Comparative Examples 3-1 to 3-4 relate to Inventions 8 to 12 and 14 to 15 in which the dielectric particles were used. Meanwhile, in the following descriptions, the terms "part(s)" and "%" mean "part(s) by weight" and "% by weight", respectively, unless otherwise specified.

<Measuring Methods>

The average particle diameter of the ferromagnetic iron oxide particles is expressed by the value determined from Fere diameters of 300 particles observed on a transmission electron micrograph thereof.

The shape of the ferromagnetic iron oxide particles was determined from micrographs obtained by observing particles using the above transmission electron microscope and a scanning electron microscope "S-4800" manufactured by Hitachi High-Technologies Corp.

The BET specific surface area value of the particles was measured by a BET method using "Mono Sorb MS-II" manufactured by Yuasa Ionics Co., Ltd.

The saturation magnetization was expressed by the value measured using a vibration sample-type magnetometer "VSM-3S-15" manufactured by Toei Kogyo Co., Ltd., by applying an external magnetic field of 795.8 kA/m (10 kOe) thereto.

The amounts of metal elements contained in the ferromagnetic iron oxide particles were measured by a "Fluorescent X-ray Analyzer RIX-2100" manufactured by Rigaku Denki Kogyo Co., Ltd., and expressed by the values determined in terms of the respective elements based on the ferromagnetic iron oxide particles.

The average particle diameter of the spherical magnetic composite particles was expressed by the volume-median particle diameter measured using a laser diffraction particle size distribution meter "LA750" manufactured by Horiba Seisakusho Co., Ltd.

The relative dielectric constant was measured and evaluated with respect to a molded product previously prepared by the following method. That is, 3 g of a sample to be measured were mixed with 1 mL of a 2% PVA aqueous solution, and the resulting mixture was formed into a molded product having an outer diameter of 7 mm, an inner diameter of 3 mm and a thickness of 2 mm. The thus obtained molded product was dried at 60° C. for 6 hr to thereby obtain a molded product for measurement of a dielectric constant (ring core for coaxial tube test).

[Measurement of Dielectric Constant]

The thus prepared molded product was subjected to measurement of a dielectric constant thereof using a network analyzer "N5230" manufactured by Agilent Corp., at a frequency of 100 MHz by a coaxial tube S parameter method.

The ten point mean roughness (Rz), maximum height (Ry), arithmetic mean roughness (Ra) and mean spacing of profile irregularities (Sm) of the surface of the spherical magnetic composite particles were determined by observing a visual field of 1000 times per one spherical magnetic composite particle using an ultra-depth color 3D profile measuring laser scanning microscope "VK-9700" manufactured by Keyence Corp., according to JIS B0601. The measurement of the particle shape was conducted as follows. That is, by setting a measuring distance to 10 μm around a central portion of the spherical magnetic composite particle as a center point, the measurement was conducted at 8 points angularly spaced around the center point from each other at intervals of 45° to obtain an average of the 8 measured values. Further, 100 carrier particles optionally selected from the spherical magnetic composite particles were subjected to the same measurement as above to obtain an average of these measured values. Meanwhile, before measuring the particle shape, the correction was previously carried out in order to reduce an error of the measurement.

The shape of the spherical magnetic composite particles was determined from micrographs obtained by observing the particles using a scanning electron microscope "S-4800" manufactured by Hitachi High-Technologies Corp.

The true specific gravity was measured using a multi-volume meter "1305 Type" manufactured by Mictromeritics/Shimadzu Seisakusho Corp.

The electric resistance value (volume resistivity) of the spherical magnetic composite particles was expressed by the value obtained by measuring 1.0 g of sample particles using a "High Resistance Meter 4339B" manufactured by Yokogawa Hewlett Packard Co., Ltd.

The sphericity was determined as follows. That is, a major axis diameter (l) and a minor axis diameter (w) of one particle were measured from an SEM micrograph on which 200 or more spherical magnetic composite particles observed by a scanning electron microscope "S-4800" manufactured by Hitachi High-Technologies Corp., were present. The sphericity was expressed by the ratio of l/w.

The content of melamine based on the spherical magnetic composite particles was calculated in terms of an amount of nitrogen determined using a trace total nitrogen analyzer "TN-110" manufactured by Dia Instruments Co., Ltd.

<Durability Test of Resin-Coated Carrier>

The resin-coated carrier was subjected to durability test as follows. That is, 10 g of a sample of the resin-coated carrier were charged into a sample mill "K-M10" manufactured by Kyoritsu Riko Co., Ltd., and stirred at a rotating speed of 16000 rpm for 30 sec.

The evaluation of a durability of the particles was carried out as follows. That is, as expressed by the following formula, the change in particle size distribution between before and after the stirring was examined to measure a rate of increase in volume percentage of the particles having a particle diameter of not more than 22 μm, and further calculate a rate of generation of fine particles from the thus measured increase rate. The results were evaluated according to the following five ratings.

Rate of generation of fine particles (%)=(volume percentage of particles having a particle diameter of not more than 22 μm after stirring)−(volume percentage of particles having a particle diameter of not more than 22 μm before stirring)

A: Rate of generation of fine particles as measured before and after the durability test was not less than 0% and less than 0.1%;

B: Rate of generation of fine particles as measured before and after the durability test was not less than 0.1% and less than 0.5%;

C: Rate of generation of fine particles as measured before and after the durability test was not less than 0.5% and less than 1.0%;

D: Rate of generation of fine particles as measured before and after the durability test was not less than 1.0% and less than 3.0%; and E: Rate of generation of fine particles as measured before and after the durability test was not less than 3.0%.

The surface conditions (such as peeling-off and abrasion of the resin coating layer, etc.) of the magnetic carrier after subjected to the durability test were observed using a scanning electron microscope, and the observation results were evaluated according to the following three ratings.

A: No peeling-off nor abrasion of the coating layer occurred;

B: Slight peeling-off or slight abrasion of the coating layer occurred; and

C: Severe peeling-off or severe abrasion of the coating layer occurred.

<Forced Deterioration Test of Spherical Magnetic Composite Particles and Rein-Coated Carrier>

Fifty parts of the spherical magnetic composite particles or the resin-coated magnetic carrier were charged into a 100-cc glass sampling bottle. After the bottle was plugged, the contents of the bottle were shaken for 24 hr using a paint conditioner manufactured by Red Devil Inc. The charge amounts and electric resistance values of the respective samples before and after the shaking were measured, and further the surface of the respective sample particles was observed using a scanning electron microscope "S-4800" manufactured by Hitachi Ltd., to confirm whether or not any peeling-off or abrasion occurred thereon.

The electric resistance value was evaluated by the rate of change (%) in electric resistance value of the respective samples as measured at normal temperature and normal humidity (24° C. and 60% RH) as represented by the following formula, and the results were evaluated according to the following five ratings.

$$\text{Rate of change in electric resistance value (\%)}=R/R_{INI}\times 100$$

wherein R is an electric resistance value after the forced deterioration test at an applied voltage of 100 V; and $R_{INI}$ is an electric resistance value before the forced deterioration test at an applied voltage of 100 V.

A: Rate of change in electric resistance value between before and after forced deterioration test was not less than 0% and less than 5%;

B: Rate of change in electric resistance value between before and after forced deterioration test was not less than 5% and less than 10%;

C: Rate of change in electric resistance value between before and after forced deterioration test was not less than 10% and less than 20%;

D: Rate of change in electric resistance value between before and after forced deterioration test was not less than 20% and less than 30%; and E: Rate of change in electric resistance value between before and after forced deterioration test was not less than 30%.

The charge amount before and after the forced deterioration test was expressed by the rate of change in charge amount of the respective samples between before and after the shaking at normal temperature and normal humidity (24° C. and 60% RH) as represented by the following formula, and the results were evaluated according to the following ratings in which the level C or higher level shows a practically usable level. The developer was prepared by sufficiently mixing 95 parts of the composite particles or the resin-coated magnetic carrier according to the present invention and 5 parts of a negatively charging cyan toner (a).

$$\text{Rate of change in charge amount (\%)}=(1-Q/Q_{INI})\times 100$$

wherein $Q_{INI}$ is a charge amount before forced deterioration test; and Q is a charge amount after forced deterioration test.

A: Rate of change in charge amount between before and after forced deterioration test was not less than 0% and less than 5%;

B: Rate of change in charge amount between before and after forced deterioration test was not less than 5% and less than 10%;

C: Rate of change in charge amount between before and after forced deterioration test was not less than 10% and less than 20%;

D: Rate of change in charge amount between before and after forced deterioration test was not less than 20% and less than 30%; and E: Rate of change in charge amount between before and after forced deterioration test was not less than 30%.

The surface conditions (such as peeling-off and abrasion of the resin coating layer, etc.) of the magnetic carrier after subjected to the forced deterioration test were measured using a scanning electron microscope, and the measurement results were evaluated according to the following three ratings.

A: No peeling-off nor abrasion of the coating layer occurred;

B: Slight peeling-off or slight abrasion of the coating layer occurred; and

C: Severe peeling-off or severe abrasion of the coating layer occurred.

<Evaluation of Resin-Coated Carrier Based on Image Evaluation>

The developer was prepared by sufficiently mixing 95 parts of the magnetic carrier according to the present invention with 5 parts of a negatively charging cyan toner. The thus obtained developer was used to evaluate a printing stability thereof by conducting initial printing (1000 sheets) and then printing of 100,000 sheets and 1,000,000 sheets while varying a bias voltage applied thereto under environmental conditions (NN) of 24° C. and 60% RH and under environmental conditions (HH) of 30° C. and 80% RH. The results were evaluated by the following method.

Meanwhile, the results of evaluation of images were ranked. The specific evaluation method was as follows.

(1) Image Density (Inclusive of Uniformity of Solid Images)

The image density of solid images was measured using a Macbeth densitometer. The uniformity of solid images was visually determined based on a control value of a sample, and the results were evaluated according to the following five ratings in which the level C or higher level was regarded as being usable practically.

A: Reproducibility of image density of original images was good, and uniform solid images were obtained without unevenness of image density;

B: Reproducibility of image density of original images was good, and no unevenness of image density occurred;

C: Image density was suitably controlled;

D: Although image density was still controlled, non-uniform images were produced and many white stripes, etc., occurred; and E: Image density was low as a whole and large edge effect occurred, and the image density was considerably deteriorated as compared to that of the original images.

(2) Fogging:

The fogging on images was determined as follow. That is, fogging of the toner on a white solid image was measured using a colorimeter/color difference meter "CR-300" manufactured by Minolta Corp., in an L*a*b* mode thereof to obtain ΔE. The results are evaluated according to the following four ratings in which the level A or B is practically acceptable.

A: ΔE was less than 1.0;

B: ΔE was not less than 1.0 and less than 2.0;

C: ΔE was not less than 2.0 and less than 3.0;

D: ΔE was not less than 3.0.

(3) Gradation:

According to the above image evaluation, images of the initial printing operation (1,000 sheets) and subsequent printing operations (100,000 sheets and 1,000,000 sheets) were visually observed to examine the number of gradation patterns whose colors were capable of being distinguished from each other using a gray scale prepared by Eastman Kodak Company (0 to 19 gradation test charts). The results were evaluated according to the following five ratings in which the level A, B or C is practically acceptable.

A: Gradation 15 (B) or higher;

B: Gradation 13 to 14;

C: Gradation 11 to 12;

D: Gradation 7(M) to 10;

E: Gradation 6 or lower.

The charge amount of the toner was determined as follows. That is, 95 parts of the magnetic carrier were fully mixed with 5 parts of the toner produced by the following method, and the amount of electric charge generated on the toner was measured using a blow-off charge amount measuring device "TB-200" manufactured by Toshiba Chemical Corp.

(Toner Production Example)

| | |
|---|---|
| Polyester resin | 100 parts |
| Copper phthalocyanine-based colorant | 5 parts |
| Charge controlling agent (zinc di-tert-butyl salicylate compound) | 3 parts |
| Wax | 9 parts |

The above materials were fully premixed with each other using a Henschel mixer, and the resulting mixture was melted and kneaded in a twin-screw extrusion-type kneader. After being cooled, the kneaded material was pulverized using a hammer mill and then classified to obtain negatively charging blue particles having a weight-average particle diameter of 7.4 μm.

On hundred parts of the above negatively charging blue particles were mixed with 1 part of a hydrophobic silica using a Henschel mixer to obtain a negatively charging cyan toner (a).

<Ferromagnetic Iron Oxide Particles>

Various properties of the ferromagnetic iron oxide particles used as the ferromagnetic iron oxide particles (a) and the ferromagnetic iron oxide particles (b) are shown in Table 1 below.

TABLE 1

| Iron oxide particles | Properties of ferromagnetic iron oxide particles: Kind | Shape | Average particle diameter [μm] |
|---|---|---|---|
| Iron oxide particles 1 | $Fe_3O_4$ | Spherical | 0.23 |
| Iron oxide particles 2 | $Fe_3O_4$ | Spherical | 0.30 |
| Iron oxide particles 3 | $Fe_3O_4$ | Octahedral | 0.17 |
| Iron oxide particles 4 | $Fe_3O_4$ | Octahedral | 0.35 |
| Iron oxide particles 5 | $Fe_3O_4$ | Octahedral | 0.67 |
| Iron oxide particles 6 | $Fe_3O_4$ | Hexahedral | 0.15 |
| Iron oxide particles 7 | $Fe_3O_4$ | Hexahedral | 0.30 |
| Iron oxide particles 8 | $Fe_3O_4$ | Amorphous | 0.40 |
| Iron oxide particles 9 | $Fe_3O_4$ | Spherical | 0.23 |
| Iron oxide particles 10 | $Fe_3O_4$ | Spherical | 0.23 |
| Iron oxide particles 11 | $Fe_3O_4$ | Spherical | 0.23 |
| Iron oxide particles 12 | $Fe_3O_4$ | Octahedral | 0.17 |
| Iron oxide particles 13 | $Fe_3O_4$ | Octahedral | 0.35 |
| Iron oxide particles 14 | $Fe_3O_4$ | Octahedral | 0.67 |
| Iron oxide particles 15 | $Fe_3O_4$ | Hexahedral | 0.15 |
| Iron oxide particles 16 | $Fe_3O_4$ | Amorphous | 0.40 |

| Iron oxide particles | Properties of ferromagnetic iron oxide particles: Coating components: Kind | Coating components: Percentage [%] | BET specific surface area [$m^2/g$] | Saturation magnetization value [$Am^2/kg$] |
|---|---|---|---|---|
| Iron oxide particles 1 | — | — | 7.0 | 83.2 |
| Iron oxide particles 2 | — | — | 4.9 | 85.2 |
| Iron oxide particles 3 | — | — | 8.3 | 82.3 |
| Iron oxide particles 4 | — | — | 3.5 | 85.3 |
| Iron oxide particles 5 | — | — | 1.0 | 88.8 |
| Iron oxide particles 6 | — | — | 9.8 | 84.6 |
| Iron oxide particles 7 | — | — | 5.0 | 86.3 |
| Iron oxide particles 8 | — | — | 2.0 | 88.3 |
| Iron oxide particles 9 | Al | 0.3 | 7.1 | 82.8 |
| Iron oxide particles 10 | Al | 1.7 | 7.5 | 82.1 |

TABLE 1-continued

| | | | | |
|---|---|---|---|---|
| Iron oxide particles 11 | Al | 5.0 | 9.3 | 78.5 |
| Iron oxide particles 12 | Si | 1.2 | 8.5 | 81.8 |
| Iron oxide particles 13 | Al | 1.7 | 3.7 | 84.2 |
| Iron oxide particles 14 | Ti | 1.7 | 1.5 | 87.1 |
| Iron oxide particles 15 | Al | 0.7 | 10.2 | 83.5 |
| Iron oxide particles 16 | Al | 1.7 | 2.3 | 87.2 |

Lipophilic Treatment of Ferromagnetic Iron Oxide Particles

Example 1-1

Lipophilic Treatment 1

One thousand parts of iron oxide particles 4 were charged into a flask and fully stirred, and then 5.0 parts of an epoxy group-containing silane-based coupling agent ("KBM-403" (tradename) produced by Shin-Etsu Chemical Corp.) were added to the flask. The contents of the flask were heated to about 100° C. and intimately mixed and stirred at that temperature for 30 min, thereby obtaining ferromagnetic iron oxide particles (a) coated with the silane-based coupling agent.

Lipophilic Treatment 2

One thousand parts of iron oxide particles 1 were charged into a flask and fully stirred, and then 10.0 parts of an epoxy group-containing silane-based coupling agent ("KBM-403" (tradename) produced by Shin-Etsu Chemical Corp.) were added to the flask. The contents of the flask were heated to about 100° C., and then intimately mixed and stirred at that temperature for 30 min, thereby obtaining ferromagnetic iron oxide particles (b) coated with the silane-based coupling agent.

<Mixing of Ferromagnetic Iron Oxide Particles after Lipophilic Treatment>

A flask was charged with 30 parts of the ferromagnetic iron oxide particles (a) subjected to the lipophilic treatment 1 and 70 parts of the ferromagnetic iron oxide particles (b) subjected to the lipophilic treatment 2 (ra/rb=1.5), and the contents of the flask were intimately mixed and stirred at a stirring speed of 250 rpm for 30 min.

<Production of Spherical Magnetic Composite Particles>

| | |
|---|---|
| Phenol | 10 parts |
| 37% Formalin | 15 parts |
| Mixed particles of ferromagnetic iron oxide particles (a) and ferromagnetic iron oxide particles (b) | 100 parts |
| 25% Aqueous ammonia | 3.5 parts |
| Water | 15 parts |

The above materials were charged into a 1-L four-necked flask, and heated to 85° C. over 60 min while stirring at a stirring speed of 250 rpm, and then the contents of the flask were reacted and cured at the same temperature for 120 min, thereby producing composite magnetic particles comprising the ferromagnetic iron oxide particles and a cured phenol resin.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 200° C. under reduced pressure (not more than 5 mmHg) to obtain spherical magnetic composite particles.

As a result, it was confirmed that the resulting spherical magnetic composite particles had an average particle diameter of 37 μm; a ten-point mean roughness Rz of 1.20 μm; a maximum height Ry of 1.80 μm; an arithmetic mean roughness Ra of 0.25 μm; a mean spacing of profile irregularities Sm of 1.30 μm; a specific gravity of 3.82 g/cm$^3$; a saturation magnetization value of 75.4 Am$^2$/kg; and a sphericity (l/w) of 1.1. Meanwhile, the electric resistance value $R_{100}$ when applying a voltage of 100 V to the particles and the electric resistance value $R_{300}$ when applying a voltage of 300 V to the particles were not measurable because they were too low.

Figure 2:
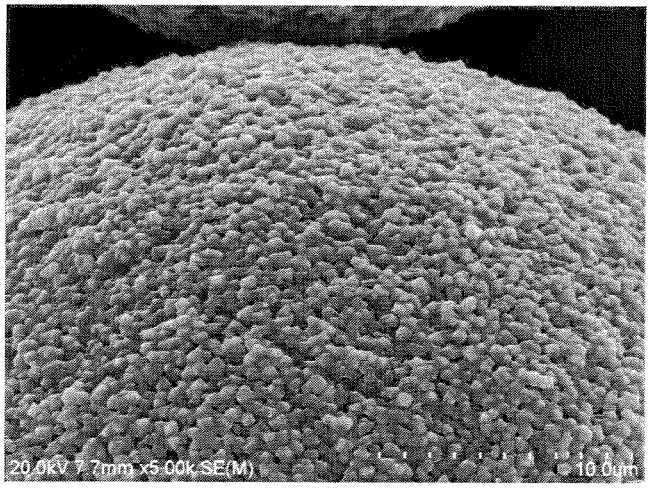
FIG. 2 is an electron micrograph showing a surface structure of spherical magnetic composite particles obtained in Example 1-1 (magnification: ×5000).
Figure 3:
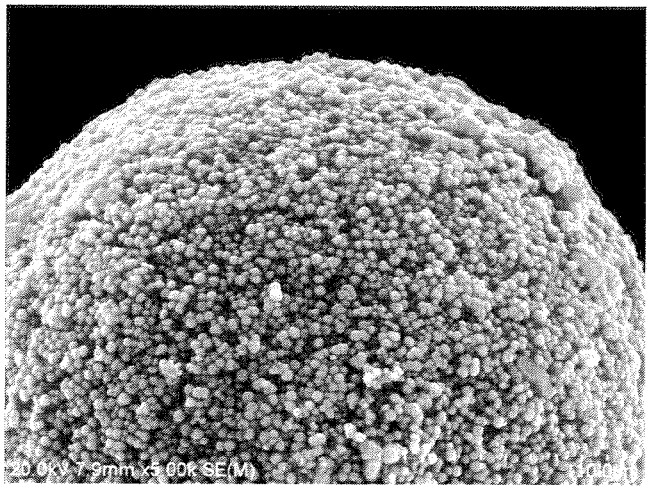
FIG. 3 is an electron micrograph showing a surface structure of spherical magnetic composite particles obtained in Example 1-4 (magnification: ×5000).
Figure 4:
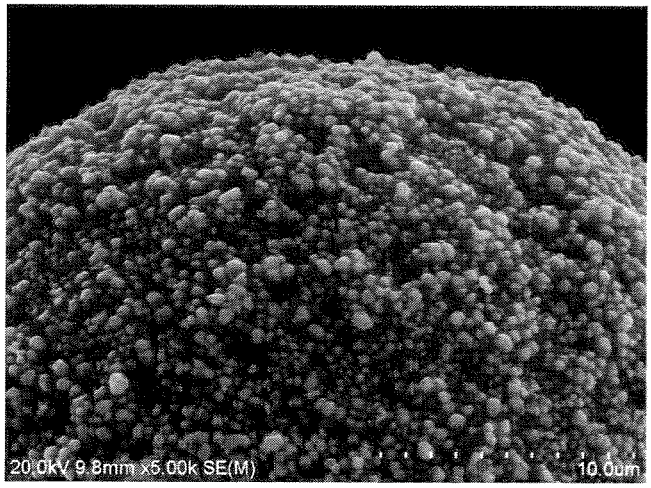
FIG. 4 is an electron micrograph showing a surface structure of spherical magnetic composite particles obtained in Example 1-5 (magnification: ×5000).

SEM micrographs of images of the thus obtained spherical magnetic composite particles and surface images thereof are shown in FIGS. 1 and 2, respectively, in which FIG. 1 shows the particle structure, whereas FIG. 2 shows the surface structure. From FIGS. 1 and 2, it was confirmed that the respective spherical magnetic composite particles had a particle shape close to a sphere, and were provided on the surface thereof with protruded portions owing to the ferromagnetic iron oxide particles (a) (in view of the average particle diameter of the ferromagnetic iron oxide particles used and the size of the protruded portions), so that fine surface irregularities were formed on the surface of the respective particles.

The production conditions of the resulting spherical magnetic composite particles are shown in Table 2, and various properties thereof are shown in Table 3.

Examples 1-2 to 1-4 and 1-6 to 1-12 and Comparative Example 1-4

The same procedure as defined in Example 1-1 was conducted under the same conditions except that the kinds of ferromagnetic iron oxide particles (a) and (b) and the mixing ratio therebetween, the kind of lipophilic treatment agent and the production conditions of spherical magnetic composite particles were changed variously, thereby obtaining the spherical composite magnetic particles.

The production conditions of the resulting spherical magnetic composite particles are shown in Table 2, and various properties thereof are shown in Table 3.

Example 1-5

Lipophilic Treatment 3

Seven hundred parts of iron oxide particles 1 and 300 parts of iron oxide particles 8 were charged into a flask and fully stirred, and then 10.0 parts of an epoxy group-containing silane-based coupling agent ("KBM-403" (tradename) produced by Shin-Etsu Chemical Corp.) were added to the flask. The contents of the flask were heated to about 100° C., and then intimately mixed and stirred for 30 min, thereby obtaining mixed particles comprising ferromagnetic iron oxide particles (a) and (b) respectively coated with the silane-based coupling agent.

The same procedure as defined in Example 1-1 was conducted under the same conditions except that the production conditions of spherical magnetic composite particles were variously changed, thereby obtaining the spherical magnetic composite particles.

The production conditions of the resulting spherical magnetic composite particles are shown in Table 2, and various properties thereof are shown in Table 3.

Comparative Examples 1-1 to 1-2 and 1-6 to 1-8

Only one kind of ferromagnetic iron oxide particles were used and subjected to lipophilic treatment 2.

The same procedure as defined in Example 1-1 was conducted under the same conditions except that the production conditions of spherical magnetic composite particles were variously changed, thereby obtaining the spherical magnetic composite particles.

The production conditions of the resulting spherical magnetic composite particles are shown in Table 2, and various properties thereof are shown in Table 3.

Comparative Example 1-3

The same procedure as defined in Example 1-1 was conducted under the same conditions except that the ferromagnetic iron oxide particles (a) and the ferromagnetic iron oxide particles (b) respectively subjected to lipophilic treatment were used without being mixed with each other for production of spherical magnetic composite particles, thereby obtaining the spherical magnetic composite particles.

The production conditions of the resulting spherical magnetic composite particles are shown in Table 2, and various properties thereof are shown in Table 3.

Comparative Example 1-5

Follow-Up Test of Japanese Patent Application Laid-Open (KOAKI) No. 2008-40270

$Fe_2O_3$, $MnO_2$, $Mg(OH)_2$ and ZnO were weighed in amounts of 74 parts, 20 parts, 5 parts and 1 part, respectively, and then mixed and pulverized using a wet ball mill for 25 hr. Then, the thus pulverized particles were granulated and dried using a spray dryer and further subjected to pre-calcination 1 in an electric furnace at 800° C. for 7 hr. The thus obtained pre-calcined product 1 was pulverized using a wet ball mill for 2 hr. Then, the thus pulverized particles were granulated and dried using a spray dryer and further subjected to pre-calcination 2 in an electric furnace at 900° C. for 6 hr. The thus obtained pre-calcined product 2 was pulverized using a wet ball mill for 5 hr. Then, the thus pulverized particles were granulated and dried using a spray dryer and further subjected to substantial calcination in an electric furnace at 900° C. for 12 hr, thereby obtaining Mn—Mg ferrite particles.

Various properties of the thus obtained Mn—Mg ferrite particles are shown in Table 3.

TABLE 2

| Examples and Comp. Examples | Ferromagnetic iron oxide particles (a) Kind | Lipophilic treatment agent Kind |
|---|---|---|
| Example 1-1 | Iron oxide particles 4 | KBM403 |
| Example 1-2 | Iron oxide particles 4 | KBM403 |
| Example 1-3 | Iron oxide particles 7 | KBM903 |

TABLE 2-continued

| | | |
|---|---|---|
| Example 1-4 | Iron oxide particles 2 | GLYMO |
| Example 1-5 | Iron oxide particles 8 | * |
| Example 1-6 | Iron oxide particles 5 | KBM403 |
| Example 1-7 | Iron oxide particles 4 | KBM403 |
| Example 1-8 | Iron oxide particles 2 | GLYMO |
| Example 1-9 | Iron oxide particles 7 | KBM903 |
| Example 1-10 | Iron oxide particles 13 | KBM403 |
| Example 1-11 | Iron oxide particles 14 | KBM403 |
| Example 1-12 | Iron oxide particles 16 | KBM403 |
| Comp. Example 1-1 | — | — |
| Comp. Example 1-2 | — | — |
| Comp. Example 1-3 | Iron oxide particles 4 | KBM403 |
| Comp. Example 1-4 | Iron oxide particles 5 | KBM403 |
| Comp. Example 1-5 | Mn—Mg ferrite | |
| Comp. Example 1-6 | — | — |
| Comp. Example 1-7 | — | — |
| Comp. Example 1-8 | — | — |

| Examples and Comp. Examples | Ferromagnetic iron oxide particles (b) Kind | Lipophilic treatment agent Kind |
|---|---|---|
| Example 1-1 | Iron oxide particles 1 | KBM403 |
| Example 1-2 | Iron oxide particles 1 | KBM403 |
| Example 1-3 | Iron oxide particles 6 | KBM903 |
| Example 1-4 | Iron oxide particles 3 | GLYMO |
| Example 1-5 | Iron oxide particles 1 | * |
| Example 1-6 | Iron oxide particles 1 | KBM403 |
| Example 1-7 | Iron oxide particles 10 | KBM403 |
| Example 1-8 | Iron oxide particles 12 | KBM403 |
| Example 1-9 | Iron oxide particles 15 | KBM403 |
| Example 1-10 | Iron oxide particles 10 | KBM403 |
| Example 1-11 | Iron oxide particles 12 | KBM403 |
| Example 1-12 | Iron oxide particles 15 | KBM403 |
| Comp. Example 1-1 | Iron oxide particles 1 | KBM403 |
| Comp. Example 1-2 | Iron oxide particles 3 | GLYMO |
| Comp. Example 1-3 | Iron oxide particles 1 | KBM403 |
| Comp. Example 1-4 | Iron oxide particles 1 | KBM403 |
| Comp. Example 1-5 | Granulation, drying and calcination by spray dry method | |
| Comp. Example 1-6 | Iron oxide particles 9 | KBM403 |
| Comp. Example 1-7 | Iron oxide particles 10 | KBM403 |
| Comp. Example 1-8 | Iron oxide particles 11 | KBM403 |

| Examples and Comp. Examples | Weight ratio a/b | Particle diameter ratio ra/rb | Basic catalyst Kind | Basic catalyst Amount (parts) |
|---|---|---|---|---|
| Example 1-1 | 30/70 | 1.5 | Aqueous ammonia | 3.5 |
| Example 1-2 | 10/90 | 1.5 | Aqueous ammonia | 4.2 |
| Example 1-3 | 30/70 | 2.0 | Aqueous ammonia | 3.5 |
| Example 1-4 | 30/70 | 1.8 | Aqueous ammonia | 4.6 |
| Example 1-5 | 30/70 | 1.7 | Aqueous ammonia | 3.2 |
| Example 1-6 | 30/70 | 2.9 | Aqueous ammonia | 3.5 |
| Example 1-7 | 30/70 | 1.5 | Aqueous ammonia | 3.5 |
| Example 1-8 | 30/70 | 1.8 | Aqueous ammonia | 4.6 |
| Example 1-9 | 30/70 | 2.0 | Aqueous ammonia | 3.5 |
| Example 1-10 | 30/70 | 1.5 | Aqueous ammonia | 4.2 |
| Example 1-11 | 30/70 | 3.9 | Aqueous ammonia | 3.5 |
| Example 1-12 | 30/70 | 2.7 | Aqueous ammonia | 3.5 |

TABLE 2-continued

| | | | | |
|---|---|---|---|---|
| Comp. Example 1-1 | — | — | Aqueous ammonia | 4.6 |
| Comp. Example 1-2 | — | — | Aqueous ammonia | 4.6 |
| Comp. Example 1-3 | 30/70 | 1.5 | Aqueous ammonia | 3.5 |
| Comp. Example 1-4 | 70/30 | 2.9 | Aqueous ammonia | 3.5 |
| Comp. Example 1-5 | Granulation, drying and calcination by spray dry method | | | |
| Comp. Example 1-6 | — | — | Aqueous ammonia | 4.6 |
| Comp. Example 1-7 | — | — | Aqueous ammonia | 4.6 |
| Comp. Example 1-8 | — | — | Aqueous ammonia | 4.6 |

| | Binder resin | | Aldehyde compound | | Water |
|---|---|---|---|---|---|
| Examples and Comp. Examples | Kind | Amount [parts] | Kind | Amount [parts] | Amount [parts] |
| Example 1-1 | Phenol | 10.0 | Formalin | 15.0 | 15.0 |
| Example 1-2 | Phenol | 12.0 | Formalin | 18.0 | 15.0 |
| Example 1-3 | Phenol | 10.0 | Formalin | 15.0 | 15.0 |
| Example 1-4 | Phenol | 13.0 | Formalin | 19.5 | 15.0 |
| Example 1-5 | Phenol | 9.0 | Formalin | 13.5 | 15.0 |
| Example 1-6 | Phenol | 10.0 | Formalin | 15.0 | 15.0 |
| Example 1-7 | Phenol | 10.0 | Formalin | 15.0 | 15.0 |
| Example 1-8 | Phenol | 13.0 | Formalin | 19.5 | 15.0 |
| Example 1-9 | Phenol | 10.0 | Formalin | 15.0 | 15.0 |
| Example 1-10 | Phenol | 12.0 | Formalin | 18.0 | 15.0 |
| Example 1-11 | Phenol | 10.0 | Formalin | 15.0 | 15.0 |
| Example 1-12 | Phenol | 10.0 | Formalin | 15.0 | 15.0 |
| Comp. Example 1-1 | Phenol | 13.0 | Formalin | 19.5 | 15.0 |
| Comp. Example 1-2 | Phenol | 13.0 | Formalin | 19.5 | 15.0 |
| Comp. Example 1-3 | Phenol | 10.0 | Formalin | 15.0 | 15.0 |
| Comp. Example 1-4 | Phenol | 10.0 | Formalin | 15.0 | 15.0 |
| Comp. Example 1-5 | Granulation, drying and calcination by spray dry method | | | | |
| Comp. Example 1-6 | Phenol | 13.0 | Formalin | 19.5 | 15.0 |
| Comp. Example 1-7 | Phenol | 13.0 | Formalin | 19.5 | 15.0 |
| Comp. Example 1-8 | Phenol | 13.0 | Formalin | 19.5 | 15.0 |

Note

*: 10 g of KBM403 were added to a mixture prepared by fully mixing 300 g of ferromagnetic iron oxide particles (a) and 700 g of ferromagnetic iron oxide particles (b), and the resulting mixture was subjected to lipophilic treatment.

TABLE 3

| | Properties of magnetic carrier | | | |
|---|---|---|---|---|
| Examples and Comp. Examples | Average particle diameter [μm] | Shape | Rz [μm] | Ry [μm] |
| Example 1-1 | 37 | Spherical | 1.20 | 1.80 |
| Example 1-2 | 42 | Spherical | 0.50 | 1.70 |
| Example 1-3 | 36 | Spherical | 0.60 | 1.10 |
| Example 1-4 | 35 | Spherical | 0.30 | 0.70 |
| Example 1-5 | 33 | Spherical | 0.90 | 2.40 |
| Example 1-6 | 45 | Spherical | 1.60 | 2.00 |
| Example 1-7 | 35 | Spherical | 1.00 | 1.80 |
| Example 1-8 | 34 | Spherical | 0.30 | 0.80 |
| Example 1-9 | 36 | Spherical | 0.70 | 1.10 |
| Example 1-10 | 38 | Spherical | 1.30 | 1.80 |
| Example 1-11 | 40 | Spherical | 1.70 | 2.00 |
| Example 1-12 | 30 | Spherical | 1.00 | 2.40 |
| Comp. Example 1-1 | 36 | Spherical | 0.15 | 0.30 |

TABLE 3-continued

| | | | | |
|---|---|---|---|---|
| Comp. Example 1-2 | 33 | Spherical | 0.21 | 0.60 |
| Comp. Example 1-3 | 28 | Spherical | 0.26 | 1.70 |
| Comp. Example 1-4 | 60 | Spherical | 2.30 | 2.70 |
| Comp. Example 1-5 | 36 | Spherical | 2.20 | 2.60 |
| Comp. Example 1-6 | 36 | Spherical | 0.10 | 0.30 |
| Comp. Example 1-7 | 35 | Spherical | 0.20 | 0.35 |
| Comp. Example 1-8 | 25 | Spherical | 0.18 | 0.35 |

| | Properties of magnetic carrier | | | |
|---|---|---|---|---|
| | | | Applied voltage | |
| Examples and Comp. Examples | Ra [μm] | Sm [μm] | Electric resistance value at applied voltage of 100 V (Ω · cm) | Electric resistance value at applied voltage of 300 V (Ω · cm) |
| Example 1-1 | 0.25 | 1.30 | ** | ** |
| Example 1-2 | 0.16 | 2.00 | ** | ** |
| Example 1-3 | 0.23 | 2.20 | ** | ** |
| Example 1-4 | 0.13 | 1.00 | ** | ** |
| Example 1-5 | 0.27 | 2.90 | ** | ** |
| Example 1-6 | 0.35 | 0.60 | ** | ** |
| Example 1-7 | 0.27 | 1.30 | 1.4E+11 | 4.2E+10 |
| Example 1-8 | 0.15 | 1.10 | 2.8E+09 | 9.8E+08 |
| Example 1-9 | 0.24 | 2.30 | 5.1E+08 | 1.2E+08 |
| Example 1-10 | 0.26 | 1.40 | 6.7E+11 | 3.6E+11 |
| Example 1-11 | 0.36 | 0.80 | 5.3E+10 | 2.7E+10 |
| Example 1-12 | 0.26 | 2.80 | 8.7E+09 | 4.8E+09 |
| Comp. Example 1-1 | 0.05 | 0.50 | ** | ** |
| Comp. Example 1-2 | 0.08 | 1.00 | ** | ** |
| Comp. Example 1-3 | 0.25 | 4.50 | ** | ** |
| Comp. Example 1-4 | 0.65 | 3.50 | ** | ** |
| Comp. Example 1-5 | 0.50 | 2.00 | ** | ** |
| Comp. Example 1-6 | 0.04 | 0.50 | 2.5E+08 | ** |
| Comp. Example 1-7 | 0.07 | 0.50 | 1.0E+11 | 3.7E+10 |
| Comp. Example 1-8 | 0.07 | 0.60 | 1.1E+13 | 3.0E+11 |

| | Properties of magnetic carrier | | |
|---|---|---|---|
| Examples and Comp. Examples | $R_{300}/R_{100}$ | Content of ferromagnetic iron oxide particles (a + b) [%] | Specific gravity [g/cm$^3$] |
| Example 1-1 | — | 88.8 | 3.82 |
| Example 1-2 | — | 88.9 | 3.50 |
| Example 1-3 | — | 88.6 | 3.81 |
| Example 1-4 | — | 88.5 | 3.77 |
| Example 1-5 | — | 89.2 | 3.86 |
| Example 1-6 | — | 86.7 | 3.42 |
| Example 1-7 | 0.30 | 88.7 | 3.78 |
| Example 1-8 | 0.35 | 89.0 | 3.82 |
| Example 1-9 | 0.24 | 88.5 | 3.75 |
| Example 1-10 | 0.54 | 86.9 | 3.65 |
| Example 1-11 | 0.51 | 88.2 | 3.54 |
| Example 1-12 | 0.55 | 87.0 | 3.88 |
| Comp. Example 1-1 | — | 87.8 | 3.72 |
| Comp. Example 1-2 | — | 89.5 | 3.88 |
| Comp. Example 1-3 | — | 87.3 | 3.88 |
| Comp. Example 1-4 | — | 85.3 | 3.88 |

TABLE 3-continued

| | | | |
|---|---|---|---|
| Comp. Example 1-5 | — | — | 5.20 |
| Comp. Example 1-6 | — | 86.5 | 3.72 |
| Comp. Example 1-7 | 0.37 | 87.0 | 3.76 |
| Comp. Example 1-8 | 0.03 | 85.5 | 3.89 |

| Examples and Comp. Examples | Properties of magnetic carrier: Saturation magnetization value [$Am^2/kg$] | Sphericity [l/w] |
|---|---|---|
| Example 1-1 | 75.4 | 1.1 |
| Example 1-2 | 73.4 | 1.1 |
| Example 1-3 | 76.6 | 1.1 |
| Example 1-4 | 72.4 | 1.1 |
| Example 1-5 | 77.1 | 1.1 |
| Example 1-6 | 76.4 | 1.1 |
| Example 1-7 | 74.8 | 1.1 |
| Example 1-8 | 72.1 | 1.1 |
| Example 1-9 | 75.9 | 1.1 |
| Example 1-10 | 72.8 | 1.1 |
| Example 1-11 | 75.1 | 1.1 |
| Example 1-12 | 76.1 | 1.1 |
| Comp. Example 1-1 | 72.4 | 1.1 |
| Comp. Example 1-2 | 71.6 | 1.1 |
| Comp. Example 1-3 | 75.4 | 1.1 |
| Comp. Example 1-4 | 76.4 | 1.1 |
| Comp. Example 1-5 | 52.3 | 1.1 |
| Comp. Example 1-6 | 72.0 | 1.1 |
| Comp. Example 1-7 | 71.4 | 1.1 |
| Comp. Example 1-8 | 68.3 | 1.1 |

Note
**: Not measurable because of excessively low electric resistance value

Production of Resin-Coated Carrier

Example 1-13

Under a nitrogen flow, a Henschel mixer was charged with 1000 parts of the spherical magnetic composite particles obtained in Example 1-1, 10 parts as a solid content of a silicone-based resin (tradename "KR251" produced by Shin-Etsu Chemical Co., Ltd.) and 1.5 parts of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the silicone-based resin comprising carbon black on the surface of the respective particles.

The thus obtained resin-coated magnetic carrier had an average particle diameter of 39 μm, a specific gravity of 3.69 $g/cm^3$, a saturation magnetization value of 72.9 $Am^2/kg$, an electric resistance value $R_{100}$ of $7.2\times10^{12}$ Ω·cm as measured upon applying a voltage of 100 V thereto, and an electric resistance value $R_{300}$ of $2.7\times10^{12}$ Ω·cm as measured upon applying a voltage of 300 V thereto.

The silicone-based resin coating layer of the thus obtained resin coated carrier particles was observed using a scanning electron microscope ("S-4800" manufactured by Hitachi Ltd.). As a result, it was confirmed that the resin coating layer was uniformly and sufficiently formed.

Examples 1-14 to 1-24 and Comparative Examples 1-9 to 1-16

The same procedure as defined in Example 1-13 was conducted under the same conditions except that the kind of spherical magnetic composite particles, the kind of coating resin and the resin coating amount were variously changed, thereby obtaining resin-coated magnetic carriers.

The production conditions and various properties of the thus obtained resin-coated magnetic carriers are shown in Table 4, and the results of evaluation of a durability and a printing stability thereof are shown in Table 5.

TABLE 4

| Examples and Comp. Examples | Core particles Kind | Coating resin: Kind | Coating resin: Amount [part(s)] |
|---|---|---|---|
| Example 1-13 | Example 1-1 | Silicone-based resin | 1 |
| Example 1-14 | Example 1-2 | Silicone-based resin | 1 |
| Example 1-15 | Example 1-3 | Silicone-based resin | 1.5 |
| Example 1-16 | Example 1-4 | Silicone-based resin | 0.5 |
| Example 1-17 | Example 1-5 | Styrene-acryl-based resin | 1 |
| Example 1-18 | Example 1-6 | Silicone-based resin | 1 |
| Example 1-19 | Example 1-7 | Silicone-based resin | 1 |
| Example 1-20 | Example 1-8 | Silicone-based resin | 1 |
| Example 1-21 | Example 1-9 | Silicone-based resin | 1 |
| Example 1-22 | Example 1-10 | Silicone-based resin | 1 |
| Example 1-23 | Example 1-11 | Silicone-based resin | 1 |
| Example 1-24 | Example 1-12 | Silicone-based resin | 1 |
| Comp. Example 1-9 | Comp. Example 1-1 | Silicone-based resin | 1 |
| Comp. Example 1-10 | Comp. Example 1-2 | Silicone-based resin | 1 |
| Comp. Example 1-11 | Comp. Example 1-3 | Silicone-based resin | 1 |
| Comp. Example 1-12 | Comp. Example 1-4 | Silicone-based resin | 1 |
| Comp. Example 1-13 | Comp. Example 1-5 | Silicone-based resin | 1 |
| Comp. Example 1-14 | Comp. Example 1-6 | Silicone-based resin | 1 |
| Comp. Example 1-15 | Comp. Example 1-7 | Silicone-based resin | 1 |
| Comp. Example 1-16 | Comp. Example 1-8 | Silicone-based resin | 1 |

| Examples and Comp. Examples | Properties of magnetic carrier having resin coating layer: Average particle diameter [μm] | Specific gravity [$g/cm^3$] | Saturation magnetization value [$Am^2/kg$] |
|---|---|---|---|
| Example 1-13 | 39 | 3.69 | 72.9 |
| Example 1-14 | 44 | 3.35 | 70.3 |
| Example 1-15 | 38 | 3.65 | 73.4 |
| Example 1-16 | 37 | 3.56 | 68.4 |
| Example 1-17 | 35 | 3.74 | 74.7 |
| Example 1-18 | 47 | 3.29 | 73.6 |
| Example 1-19 | 37 | 3.72 | 73.5 |
| Example 1-20 | 36 | 3.75 | 70.7 |
| Example 1-21 | 38 | 3.69 | 74.7 |
| Example 1-22 | 40 | 3.61 | 72.0 |
| Example 1-23 | 42 | 3.50 | 74.1 |
| Example 1-24 | 32 | 3.85 | 75.6 |
| Comp. Example 1-9 | 38 | 3.52 | 68.5 |
| Comp. Example 1-10 | 35 | 3.62 | 66.7 |
| Comp. Example 1-11 | 29 | 3.54 | 68.8 |

TABLE 4-continued

| | | | |
|---|---|---|---|
| Comp. Example 1-12 | 63 | 3.72 | 73.3 |
| Comp. Example 1-13 | 38 | 5.01 | 50.4 |
| Comp. Example 1-14 | 38 | 3.54 | 68.5 |
| Comp. Example 1-15 | 37 | 3.72 | 70.6 |
| Comp. Example 1-16 | 26 | 3.66 | 64.2 |

| | Properties of magnetic carrier having resin coating layer | | |
|---|---|---|---|
| Examples and Comp. Examples | Electric resistance $R_{100}$ (Ω · cm) | Electric resistance $R_{300}$ (Ω · cm) | $R_{300}/R_{100}$ |
| Example 1-13 | 7.2E+12 | 2.7E+12 | 0.38 |
| Example 1-14 | 5.6E+12 | 1.6E+12 | 0.29 |
| Example 1-15 | 6.9E+13 | 1.8E+13 | 0.26 |
| Example 1-16 | 8.1E+11 | 1.8E+11 | 0.22 |
| Example 1-17 | 1.3E+13 | 5.1E+12 | 0.39 |
| Example 1-18 | 8.9E+11 | 3.2E+11 | 0.36 |
| Example 1-19 | 4.5E+13 | 2.7E+13 | 0.60 |
| Example 1-20 | 6.3E+12 | 3.6E+12 | 0.57 |
| Example 1-21 | 1.0E+13 | 6.3E+12 | 0.63 |
| Example 1-22 | 7.1E+13 | 5.1E+13 | 0.72 |
| Example 1-23 | 2.1E+14 | 1.4E+14 | 0.67 |
| Example 1-24 | 5.6E+14 | 4.3E+14 | 0.77 |
| Comp. Example 1-9 | 1.2E+14 | 2.1E+13 | 0.18 |
| Comp. Example 1-10 | 6.3E+13 | 7.3E+12 | 0.12 |
| Comp. Example 1-11 | 6.9E+12 | 5.2E+11 | 0.08 |
| Comp. Example 1-12 | 3.4E+14 | 8.8E+13 | 0.26 |
| Comp. Example 1-13 | 2.8E+14 | 8.5E+13 | 0.30 |
| Comp. Example 1-14 | 2.8E+13 | 6.2E+12 | 0.22 |
| Comp. Example 1-15 | 3.4E+13 | 2.4E+13 | 0.71 |
| Comp. Example 1-16 | 1.9E+15 | 2.3E+14 | 0.12 |

TABLE 5

| | | | Forced deterioration test | | |
|---|---|---|---|---|---|
| Kind of resin-coated carrier | Durability test: Dura-bility | Durability test: Surface condition | Rate of change in charge amount | Rate of change in electric resistance | Surface condition |
| Example 1-13 | A | A | A | A | A |
| Example 1-14 | A | A | A | A | A |
| Example 1-15 | A | A | A | A | A |
| Example 1-16 | A | A | A | A | A |
| Example 1-17 | A | A | A | A | A |
| Example 1-18 | A | A | A | A | A |
| Example 1-19 | A | A | A | A | A |
| Example 1-20 | A | A | A | A | A |
| Example 1-21 | A | A | A | A | A |
| Example 1-22 | A | A | A | A | A |
| Example 1-23 | A | A | A | A | A |
| Example 1-24 | A | A | A | A | A |
| Comp. Ex. 1-9 | C | B | B | B | B |
| Comp. Ex. 1-10 | C | B | C | C | B |
| Comp. Ex. 1-11 | D | C | D | D | C |
| Comp. Ex. 1-12 | E | C | E | E | C |
| Comp. Ex. 1-13 | C | B | C | C | B |
| Comp. Ex. 1-14 | C | B | B | B | B |
| Comp. Ex. 1-15 | C | B | B | B | B |
| Comp. Ex. 1-16 | C | B | B | B | B |

| | Evaluation of printing stability Image density | | | | | |
|---|---|---|---|---|---|---|
| Kind of resin-coated carrier | Initial | | After printing 100,000 sheets | | After printing 1,000,000 sheets | |
| | NN | HH | NN | HH | NN | HH |
| Example 1-13 | A | A | A | A | C | D |
| Example 1-14 | A | A | A | A | C | D |
| Example 1-15 | A | A | A | A | C | D |
| Example 1-16 | A | A | A | A | C | D |
| Example 1-17 | A | A | A | A | C | D |
| Example 1-18 | A | A | A | A | C | D |
| Example 1-19 | A | A | A | A | B | C |
| Example 1-20 | A | A | A | A | B | C |
| Example 1-21 | A | A | A | A | B | C |
| Example 1-22 | A | A | A | A | B | B |
| Example 1-23 | A | A | A | A | B | B |
| Example 1-24 | A | A | A | A | B | B |
| Comp. Example 1-9 | A | A | B | C | D | E |
| Comp. Example 1-10 | A | A | B | C | D | E |
| Comp. Example 1-11 | A | C | E | E | E | E |
| Comp. Example 1-12 | B | C | E | E | E | E |
| Comp. Example 1-13 | A | A | B | C | D | E |
| Comp. Example 1-14 | A | A | D | D | D | E |
| Comp. Example 1-15 | A | A | D | D | D | E |
| Comp. Example 1-16 | A | A | D | D | D | E |

| | Evaluation of printing stability Fogging | | | | | |
|---|---|---|---|---|---|---|
| Kind of resin-coated carrier | Initial | | After printing 100,000 sheets | | After printing 1,000,000 sheets | |
| | NN | HH | NN | HH | NN | HH |
| Example 1-13 | A | A | A | A | C | C |
| Example 1-14 | A | A | A | A | C | C |
| Example 1-15 | A | A | A | A | C | C |
| Example 1-16 | A | A | A | A | C | C |
| Example 1-17 | A | A | A | A | C | C |
| Example 1-18 | A | A | A | A | C | C |
| Example 1-19 | A | A | A | A | B | B |
| Example 1-20 | A | A | A | A | B | B |
| Example 1-21 | A | A | A | A | B | B |
| Example 1-22 | A | A | A | A | B | B |
| Example 1-23 | A | A | A | A | B | B |
| Example 1-24 | A | A | A | A | B | B |
| Comp. Example 1-9 | A | A | B | B | C | D |
| Comp. Example 1-10 | A | A | B | B | C | D |
| Comp. Example 1-11 | A | A | D | D | D | D |
| Comp. Example 1-12 | A | A | D | D | D | D |
| Comp. Example 1-13 | A | A | B | C | D | D |
| Comp. Example 1-14 | A | A | D | D | D | D |
| Comp. Example 1-15 | A | A | D | D | D | D |

TABLE 5-continued

| | | | | | | |
|---|---|---|---|---|---|---|
| Comp. Example 1-16 | A | A | D | D | D | D |

| Kind of resin-coated carrier | Evaluation of printing stability Gradation | | | | | |
|---|---|---|---|---|---|---|
| | Initial | | After printing 100,000 sheets | | After printing 1,000,000 sheets | |
| | NN | HH | NN | HH | NN | HH |
| Example 1-13 | A | A | B | C | D | D |
| Example 1-14 | A | A | B | C | D | D |
| Example 1-15 | A | A | B | C | D | D |
| Example 1-16 | A | A | B | C | D | D |
| Example 1-17 | A | A | B | C | D | D |
| Example 1-18 | A | A | B | C | D | D |
| Example 1-19 | A | A | A | B | C | C |
| Example 1-20 | A | A | A | B | C | C |
| Example 1-21 | A | A | A | B | C | C |
| Example 1-22 | A | A | A | A | B | C |
| Example 1-23 | A | A | A | B | C | C |
| Example 1-24 | A | A | A | B | C | C |
| Comp. Example 1-9 | A | A | D | E | E | E |
| Comp. Example 1-10 | A | A | D | E | E | E |
| Comp. Example 1-11 | D | D | D | E | E | E |
| Comp. Example 1-12 | D | D | D | E | E | E |
| Comp. Example 1-13 | A | A | D | D | E | E |
| Comp. Example 1-14 | A | A | D | D | E | E |
| Comp. Example 1-15 | A | A | A | C | E | E |
| Comp. Example 1-16 | A | A | D | D | E | E |

As shown in Table 5, the magnetic carriers and the developers according to the present invention were excellent in adhesion to the coating resins without occurrence of peeling-off and abrasion of the resins when subjected to durability test, so that uniform solid black images having an excellent image quality and a high image density could be reproduced. In addition, by using the ferromagnetic iron oxide particles subjected to the coating treatment, it was possible to adequately control an electric resistance of the magnetic carriers and maintain a low voltage dependency thereof over a long period of time. As a result, it was confirmed that the magnetic carriers obtained according to the present invention were capable of forming images having an excellent gradation even after printing 1,000,000 sheets as compared to those obtained in Comparative Examples.

Example 2-1

Production of Spherical Magnetic Composite Particles

| | |
|---|---|
| Phenol | 10 parts |
| 37% Formalin | 15 parts |
| Mixed particles of ferromagnetic iron oxide particles (a) and ferromagnetic iron oxide particles (b) | 100 parts |
| 25% Aqueous ammonia | 3.5 parts |
| Water | 15 parts |

The above materials were charged into a 1-L four-necked flask, and heated to 85° C. over 60 min while stirring at a stirring speed of 250 rpm, and then the contents of the flask were reacted and cured at the same temperature for 120 min, thereby producing spherical magnetic composite particles comprising the ferromagnetic iron oxide particles and a cured phenol resin.

Separately, an acid catalyst comprising 0.3 part of water and 0.5 part of a 99% glacial acetic acid aqueous solution was prepared.

Separately, an aqueous solution comprising 1.5 parts of water, 0.5 part of a melamine powder and 1.3 parts of 37% formalin was heated to about 60° C. while stirring at a stirring speed of 250 rpm for 60 min, and then further stirred for about 40 min, thereby preparing a transparent methylol melamine solution.

Next, while the reaction solution comprising the above produced spherical magnetic composite particles was stirred at a stirring speed of 250 rpm, the above acid catalyst and the above transparent methylol melamine solution were added to the flask maintained at a reaction temperature of 85° C., and the contents of the flask were reacted for 120 min, thereby obtaining spherical composite particles comprising the spherical composite core particles and a melamine resin coating layer formed on the surface of the respective core particles.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 200° C. under reduced pressure (not more than 5 mmHg) to obtain spherical magnetic composite particles 1.

As a result, it was confirmed that the resulting spherical magnetic composite particles had an average particle diameter of 37.0 μm; a ten-point mean roughness Rz of 0.90 μm; a maximum height Ry of 1.90 μm; an arithmetic mean roughness Ra of 0.30 μm; a mean spacing of profile irregularities Sm of 4.00 μm; a specific gravity of 3.80 g/cm$^3$; a saturation magnetization value of 75.4 Am$^2$/kg; and a sphericity (l/w) of 1.1. Further, it was confirmed that the electric resistance value $R_{100}$ of the spherical magnetic composite particles when applying a voltage of 100 V thereto was $9.8\times10^{10}$ Ω·cm, the electric resistance value $R_{300}$ of the spherical magnetic composite particles when applying a voltage of 300 V thereto was $4.2\times10^{10}$ Ω·cm, and the ratio of $R_{300}/R_{100}$ was 0.43.

Figure 7:
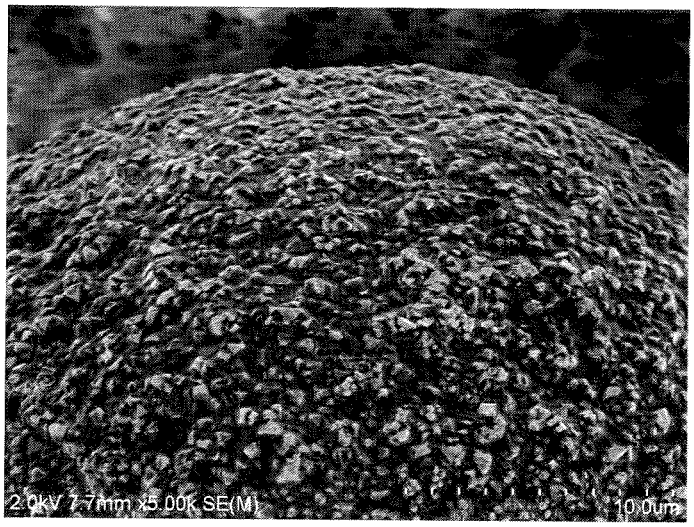
FIG. 7 is an electron micrograph showing a surface structure of spherical magnetic composite particles obtained in Example 2-1 (magnification: ×5000).

The SEM micrograph of surface images of the thus obtained spherical magnetic composite particles is shown in FIG. 7. As shown In FIG. 7, it was confirmed that the respective spherical magnetic composite particles had a particle shape close to a sphere, and were provided on the surface thereof with protruded portions owing to the ferromagnetic iron oxide particles (a), so that fine surface irregularities were formed on the surface of the respective particles.

The production conditions of the resulting spherical magnetic composite particles are shown in Table 6, and various properties of the spherical magnetic composite particles as well as the results of forced deterioration test thereof are shown in Table 7.

As a result, it was confirmed that when subjected to forced deterioration test, the rates of change in charge amount and electric resistance value of the spherical magnetic composite particles both were small, and there were observed substantially no occurrence of peeling-off and abrasion on the surface of the particles.

Examples 2-2 to 2-3 and 2-5 to 2-6 and Comparative Example 2-3

The same procedure as defined in Example 2-1 was conducted under the same conditions except that the kind of ferromagnetic iron oxide particles (a) and (b) and the mixing ratio therebetween, the kind of lipophilic treatment agent and the production conditions of spherical magnetic composite particles were changed variously, thereby obtaining the spherical composite magnetic particles.

The production conditions of the resulting spherical magnetic composite particles are shown in Table 6, and various properties of the spherical magnetic composite particles and the results of forced deterioration test thereof are shown in Table 7.

Example 2-4

Lipophilic Treatment 4

300 parts of iron oxide particles 2 and 700 parts of iron oxide particles 1 were charged into a flask and fully stirred, and then 10.0 parts of an epoxy group-containing silane-based coupling agent ("KBM-403" (tradename) produced by Shin-Etsu Chemical Co. Ltd.) were added to the flask. The contents of the flask were heated to about 100° C., and then intimately mixed and stirred at that temperature for 30 min, thereby obtaining mixed particles comprising ferromagnetic iron oxide particles (a) and (b) respectively coated with the silane-based coupling agent.

The same procedure as defined in Example 2-1 was conducted under the same conditions except that the production conditions of spherical magnetic composite particles were variously changed, thereby obtaining the spherical magnetic composite particles.

The production conditions of the resulting spherical magnetic composite particles are shown in Table 6, and various properties of the spherical magnetic composite particles and the results of forced deterioration test thereof are shown in Table 7.

Comparative Example 2-1

Production of Spherical Magnetic Composite Particles

| | |
|---|---|
| Phenol | 13 parts |
| 37% Formalin | 19.5 parts |
| Particles subjected to lipophilic treatment 1 | 100 parts |
| 25% Aqueous ammonia | 4.6 parts |
| Water | 15 parts |

The above materials were charged into a 1-L four-necked flask, and heated to 85° C. over 60 min while stirring at a stirring speed of 250 rpm, and then the contents of the flask were reacted and cured at the same temperature for 120 min, thereby producing spherical magnetic composite particles comprising the ferromagnetic iron oxide particles and a cured phenol resin.

The same procedure as defined in Example 2-1 was conducted except that the thus obtained spherical magnetic composite particles were used, thereby obtaining spherical composite particles respectively provided on the surface thereof with a melamine resin coating layer.

As a result of observing the thus obtained spherical composite particles using SEM, it was confirmed that the respective spherical composite particles had a particle shape close to a sphere, but no fine surface irregularities were recognized on the surface of the respective particles, and the surface was even and smooth.

The production conditions of the resulting spherical magnetic composite particles are shown in Table 6, and various properties of the spherical magnetic composite particles as well as the results of forced deterioration test thereof are shown in Table 7.

It was confirmed that the spherical composite particles obtained in Comparative Example 2-1 had a high rate of change in charge amount when subjected to forced deterioration test, and the surface thereof suffered from peeling-off and abrasion, etc.

Comparative Example 2-2

The same procedure as defined in Example 2-1 was conducted under the same conditions except that the ferromagnetic iron oxide particles (a) and the ferromagnetic iron oxide particles (b) respectively subjected to lipophilic treatment were used for production of spherical magnetic composite particles without being mixed with each other, thereby obtaining the spherical magnetic composite particles.

The production conditions of the resulting spherical magnetic composite particles are shown in Table 6, and various properties of the spherical magnetic composite particles as well as the results of forced deterioration test thereof are shown in Table 7.

TABLE 6

| Examples and Comp. Examples | Ferromagnetic iron oxide particles (a) Kind | Lipophilic treatment agent Kind | Ferromagnetic iron oxide particles (b) Kind | Lipophilic treatment agent Kind |
|---|---|---|---|---|
| Example 2-1 | Iron oxide particles 4 | KBM403 | Iron oxide particles 1 | KBM403 |
| Example 2-2 | Iron oxide particles 7 | KBM903 | Iron oxide particles 1 | KBM903 |
| Example 2-3 | Iron oxide particles 8 | GLYMO | Iron oxide particles 1 | GLYMO |
| Example 2-4 | Iron oxide particles 2 | * | Iron oxide particles 1 | * |
| Example 2-5 | Iron oxide particles 4 | KBM403 | Iron oxide particles 10 | KBM403 |
| Example 2-6 | Iron oxide particles 16 | KBM403 | Iron oxide particles 10 | KBM403 |
| Comp. Example 2-1 | — | — | Iron oxide particles 1 | KBM403 |
| Comp. Example 2-2 | Iron oxide particles 4 | KBM403 | Iron oxide particles 1 | KBM403 |
| Comp. Example 2-3 | Iron oxide particles 4 | KBM403 | Iron oxide particles 1 | KBM403 |

| Examples and Comp. Examples | Mixing ratio a/b | Particle diameter ratio ra/rb | Basic catalyst Kind | Basic catalyst Amount (part(s) |
|---|---|---|---|---|
| Example 2-1 | 30/70 | 1.5 | Aqueous ammonia | 3.5 |

TABLE 6-continued

| | | | | |
|---|---|---|---|---|
| Example 2-2 | 10/90 | 1.3 | Aqueous ammonia | 4.2 |
| Example 2-3 | 20/80 | 1.7 | Aqueous ammonia | 4.6 |
| Example 2-4 | 30/70 | 1.3 | Aqueous ammonia | 3.5 |
| Example 2-5 | 30/70 | 1.5 | Aqueous ammonia | 3.5 |
| Example 2-6 | 30/70 | 1.7 | Aqueous ammonia | 4.2 |
| Comp. Example 2-1 | — | — | Aqueous ammonia | 4.6 |
| Comp. Example 2-2 | 30/70 | 1.5 | Aqueous ammonia | 3.5 |
| Comp. Example 2-3 | 70/30 | 1.5 | Aqueous ammonia | 3.5 |

| Examples and Comp. Examples | Binder resin | | Aldehyde compound | | Water |
|---|---|---|---|---|---|
| | Kind | Amount [part(s)] | Kind | Amount [part(s)] | Amount [part(s)] |
| Example 2-1 | Phenol | 10.0 | Formalin | 15.0 | 15.0 |
| Example 2-2 | Phenol | 12.0 | Formalin | 18.0 | 15.0 |
| Example 2-3 | Phenol | 13.0 | Formalin | 15.0 | 15.0 |
| Example 2-4 | Phenol | 10.0 | Formalin | 15.0 | 15.0 |
| Example 2-5 | Phenol | 10.0 | Formalin | 15.0 | 15.0 |
| Example 2-6 | Phenol | 12.0 | Formalin | 18.0 | 15.0 |
| Comp. Example 2-1 | Phenol | 13.0 | Formalin | 19.5 | 15.0 |
| Comp. Example 2-2 | Phenol | 10.0 | Formalin | 15.0 | 15.0 |
| Comp. Example 2-3 | Phenol | 10.0 | Formalin | 15.0 | 15.0 |

| Examples and Comp. Examples | Acid catalyst | | |
|---|---|---|---|
| | Acid | | Water |
| | Kind | Amount [part(s)] | Amount [part(s)] |
| Example 2-1 | Acetic acid | 0.50 | 0.3 |
| Example 2-2 | Acetic acid | 0.65 | 0.4 |
| Example 2-3 | Acetic acid | 0.50 | 0.3 |
| Example 2-4 | Acetic acid | 0.50 | 0.3 |
| Example 2-5 | Acetic acid | 0.50 | 0.3 |
| Example 2-6 | Acetic acid | 0.50 | 0.3 |
| Comp. Example 2-1 | Acetic acid | 0.50 | 0.3 |
| Comp. Example 2-2 | Acetic acid | 0.50 | 0.3 |
| Comp. Example 2-3 | Acetic acid | 0.50 | 0.3 |

| Examples and Comp. Examples | Melamine solution | | | |
|---|---|---|---|---|
| | Melamine | Aldehyde compound | | Water |
| | Amount [part(s)] | Kind | Amount [part(s)] | Amount [part(s)] |
| Example 2-1 | 0.5 | Formalin | 1.3 | 1.5 |
| Example 2-2 | 0.5 | Formalin | 1.3 | 1.5 |
| Example 2-3 | 0.4 | Formalin | 1.0 | 1.2 |
| Example 2-4 | 0.7 | Formalin | 1.8 | 2.1 |
| Example 2-5 | 0.4 | Formalin | 1.0 | 1.2 |
| Example 2-6 | 0.3 | Formalin | 0.8 | 0.9 |
| Comp. Example 2-1 | 0.5 | Formalin | 1.3 | 1.5 |
| Comp. Example 2-2 | 0.5 | Formalin | 1.3 | 1.5 |
| Comp. Example 2-3 | 0.5 | Formalin | 1.3 | 1.5 |

TABLE 6-continued

| Examples and Comp. Examples | Temperature [° C.] | Time [min] | Heat treatment conditions [° C. × H] |
|---|---|---|---|
| Example 2-1 | 85 | 120 | 200 × 10 |
| Example 2-2 | 80 | 90 | 180 × 10 |
| Example 2-3 | 85 | 120 | 160 × 10 |
| Example 2-4 | 85 | 120 | 200 × 10 |
| Example 2-5 | 85 | 120 | 200 × 10 |
| Example 2-6 | 85 | 120 | 200 × 10 |
| Comp. Example 2-1 | 85 | 120 | 200 × 10 |
| Comp. Example 2-2 | 85 | 120 | 200 × 10 |
| Comp. Example 2-3 | 85 | 120 | 200 × 10 |

Note

* 10 g of KBM403 were added to a mixture prepared by fully mixing 300 g of ferromagnetic iron oxide particles (a) and 700 g of ferromagnetic iron oxide particles (b), and the resulting mixture was subjected to lipophilic treatment.

TABLE 7

| Examples and Comp. Examples | Properties of magnetic carrier | | | |
|---|---|---|---|---|
| | Average particle diameter [μm] | Shape | Rz [μm] | Ry [μm] |
| Example 2-1 | 37.0 | Spherical | 0.90 | 1.90 |
| Example 2-2 | 29.0 | Spherical | 0.70 | 1.30 |
| Example 2-3 | 30.0 | Spherical | 1.50 | 2.00 |
| Example 2-4 | 43.0 | Spherical | 1.90 | 2.50 |
| Example 2-5 | 35.0 | Spherical | 1.20 | 1.50 |
| Example 2-6 | 38.0 | Spherical | 1.80 | 1.90 |
| Comp. Example 2-1 | 34.3 | Spherical | 0.20 | 0.60 |
| Comp. Example 2-2 | 53.0 | Spherical | 0.25 | 0.40 |
| Comp. Example 2-3 | 70.0 | Spherical | 2.40 | 2.90 |

| Examples and Comp. Examples | Properties of magnetic carrier | | | |
|---|---|---|---|---|
| | | | Applied voltage | |
| | Ra [μm] | Sm [μm] | Electric resistance value at applied voltage of 100 V (Ω · cm) | Electric resistance value at applied voltage of 300 V (Ω · cm) |
| Example 2-1 | 0.30 | 4.00 | 9.8E+10 | 4.2E+10 |
| Example 2-2 | 0.22 | 5.50 | 3.7E+11 | 9.8E+10 |
| Example 2-3 | 0.50 | 3.00 | 1.1E+09 | 5.5E+08 |
| Example 2-4 | 0.60 | 5.00 | 4.3E+12 | 2.7E+12 |
| Example 2-5 | 0.30 | 2.00 | 3.7E+11 | 2.4E+11 |
| Example 2-6 | 0.55 | 1.50 | 3.3E+10 | 2.3E+10 |
| Comp. Example 2-1 | 0.06 | 1.80 | 1.4E+10 | 2.5E+09 |
| Comp. Example 2-2 | 0.05 | 1.00 | 5.2E+10 | 4.1E+08 |
| Comp. Example 2-3 | 0.95 | 3.00 | 3.1E+08 | ** |

TABLE 7-continued

| Examples and Comp. Examples | Properties of magnetic carrier: $R_{300}/R_{100}$ | Content of ferromagnetic iron oxide particles (a + b) [%] | Specific gravity [g/cm$^3$] | Saturation magnetization value [Am$^2$/kg] |
|---|---|---|---|---|
| Example 2-1 | 0.43 | 88.5 | 3.80 | 75.4 |
| Example 2-2 | 0.26 | 88.7 | 3.49 | 73.5 |
| Example 2-3 | 0.50 | 88.7 | 3.84 | 73.3 |
| Example 2-4 | 0.63 | 85.9 | 3.4 | 76.4 |
| Example 2-5 | 0.65 | 88.2 | 3.77 | 74.8 |
| Example 2-6 | 0.70 | 87.7 | 3.53 | 74.6 |
| Comp. Example 2-1 | 0.18 | 87.0 | 3.60 | 73.5 |
| Comp. Example 2-2 | 0.008 | 83.0 | 3.88 | 75.4 |
| Comp. Example 2-3 | — | 82.0 | 3.88 | 76.4 |

| Examples and Comp. Examples | Properties of magnetic carrier: Melamine amount [%] | Sphericity [l/w] | Forced deterioration test: Rate of change in charge amount | Rate of change in resistance |
|---|---|---|---|---|
| Example 2-1 | 0.24 | 1.1 | A | A |
| Example 2-2 | 0.23 | 1.1 | A | A |
| Example 2-3 | 0.20 | 1.1 | A | A |
| Example 2-4 | 0.35 | 1.1 | A | A |
| Example 2-5 | 0.20 | 1.1 | A | A |
| Example 2-6 | 0.17 | 1.1 | A | A |
| Comp. Example 2-1 | 0.17 | 1.1 | A | A |
| Comp. Example 2-2 | 0.19 | 1.1 | D | D |
| Comp. Example 2-3 | 0.09 | 1.1 | D | E |

Note
** Not measurable because of excessively low electric resistance value

Production of Resin-Coated Carrier

Example 2-7

Under a nitrogen flow, a Henschel mixer was charged with 1000 parts of the spherical magnetic composite particles obtained in Example 2-1, 10 parts as a solid content of a silicone-based resin (tradename "KR251" produced by Shin-Etsu Chemical Co., Ltd.) and 1.5 parts of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the silicone-based resin comprising carbon black on the surface of the respective particles.

The thus obtained resin-coated magnetic carrier had an average particle diameter of 39 μm, a specific gravity of 3.75 g/cm$^3$, a saturation magnetization value of 74.7 Am$^2$/kg, an electric resistance value $R_{100}$ of $5.6\times10^{13}$ Ω·cm as measured upon applying a voltage of 100 V thereto, and an electric resistance value $R_{300}$ of $3.3\times10^{13}$ Ω·cm as measured upon applying a voltage of 300 V thereto.

The silicone-based resin coating layer of the thus obtained resin coated carrier particles 1 was observed using a scanning electron microscope ("S-4800" manufactured by Hitachi Ltd.). As a result, it was confirmed that the resin coating layer was uniformly and sufficiently formed.

Examples 2-8 to 2-12 and Comparative Examples 2-4 to 2-6

The same procedure as defined in Example 2-7 was conducted under the same conditions except that the kind of spherical composite particles, the kind of coating resin and the resin coating amount were variously changed, thereby obtaining resin-coated magnetic carriers.

The production conditions and various properties of the thus obtained resin-coated magnetic carriers are shown in Table 8, and the results of evaluations of a durability, forced deterioration test and a printing stability thereof are shown in Table 9.

TABLE 8

| Examples and Comp. Examples | Core particles Kind | Composition of resin coating layer of magnetic carrier: Coating resin Kind | Ratio to core material [%] | Additives Kind | Ratio to resin [%] |
|---|---|---|---|---|---|
| Example 2-7 | Example 2-1 | Silicone-based resin | 1.0 | Carbon black | 15 |
| Example 2-8 | Example 2-2 | Silicone-based resin | 1.5 | Carbon black | 15 |
| Example 2-9 | Example 2-3 | Styrene-acryl-based resin | 1.0 | Carbon black | 15 |
| Example 2-10 | Example 2-4 | Silicone-based resin | 0.5 | Carbon black | 15 |
| Example 2-11 | Example 2-5 | Silicone-based resin | 1.0 | Carbon black | 15 |
| Example 2-12 | Example 2-6 | Silicone-based resin | 1.0 | Carbon black | 15 |
| Comp. Example 2-4 | Comp. Example 2-1 | Silicone-based resin | 1.0 | Carbon black | 15 |
| Comp. Example 2-5 | Comp. Example 2-2 | Silicone-based resin | 1.0 | Carbon black | 15 |
| Comp. Example 2-6 | Comp. Example 2-3 | Silicone-based resin | 1.0 | Carbon black | 15 |

| Examples and Comp. Examples | Properties of magnetic carrier having resin coating layer: Average particle diameter [μm] | Specific gravity [g/cm$^3$] | Saturation magnetization value [Am$^2$/kg] |
|---|---|---|---|
| Example 2-7 | 39 | 3.75 | 74.7 |
| Example 2-8 | 44 | 3.40 | 72.7 |
| Example 2-9 | 40 | 3.72 | 72.2 |
| Example 2-10 | 39 | 3.35 | 76.0 |

TABLE 8-continued

| | | | |
|---|---|---|---|
| Example 2-11 | 35 | 3.73 | 74.1 |
| Example 2-12 | 40 | 3.49 | 73.9 |
| Comp. Example 2-4 | 39 | 3.56 | 72.8 |
| Comp. Example 2-5 | 56 | 3.50 | 74.7 |
| Comp. Example 2-6 | 73 | 3.68 | 75.6 |

| Examples and Comp. Examples | Properties of magnetic carrier having resin coating layer: Electric resistance $R_{100}$ ($\Omega \cdot$ cm) | Electric resistance $R_{300}$ ($\Omega \cdot$ cm) | $R_{300}/R_{100}$ |
|---|---|---|---|
| Example 2-7 | 5.6E+13 | 3.3E+13 | 0.59 |
| Example 2-8 | 5.6E+14 | 3.5E+14 | 0.63 |
| Example 2-9 | 5.6E+11 | 4.1E+11 | 0.73 |
| Example 2-10 | 1.2E+14 | 9.2E+13 | 0.77 |
| Example 2-11 | 4.8E+13 | 3.9E+13 | 0.81 |
| Example 2-12 | 8.5E+12 | 7.6E+12 | 0.89 |
| Comp. Example 2-4 | 7.2E+14 | 2.7E+14 | 0.38 |
| Comp. Example 2-5 | 8.8E+13 | 4.2E+12 | 0.05 |
| Comp. Example 2-6 | 1.2E+14 | 1E+13 | 0.08 |

TABLE 9

| Kind of resin-coated carrier | Durability test: Durability | Durability test: Surface condition | Forced deterioration test: Rate of change in charge amount | Forced deterioration test: Rate of change in electric resistance | Forced deterioration test: Surface condition |
|---|---|---|---|---|---|
| Example 2-7 | A | A | A | A | A |
| Example 2-8 | A | A | A | A | A |
| Example 2-9 | A | A | A | A | A |
| Example 2-10 | A | A | A | A | A |
| Example 2-11 | A | A | A | A | A |
| Example 2-12 | A | A | A | A | A |
| Comp. Example 2-4 | B | B | A | A | A |
| Comp. Example 2-5 | D | C | D | D | C |
| Comp. Example 2-6 | D | C | C | D | C |

| Kind of resin-coated carrier | Evaluation of printing stability Image density: Initial NN | Initial HH | After printing 100,000 sheets NN | After printing 100,000 sheets HH | After printing 1,000,000 sheets NN | After printing 1,000,000 sheets HH |
|---|---|---|---|---|---|---|
| Example 2-7 | A | A | A | A | B | C |
| Example 2-8 | A | A | A | A | B | C |
| Example 2-9 | A | A | A | A | B | C |
| Example 2-10 | A | A | A | A | B | B |
| Example 2-11 | A | A | A | A | A | B |
| Example 2-12 | A | A | A | A | A | B |
| Comp. Example 2-4 | A | A | A | B | D | D |
| Comp. Example 2-5 | A | B | B | C | B | D |
| Comp. Example 2-6 | B | B | C | C | C | D |

| Kind of resin-coated carrier | Evaluation of printing stability Fogging: Initial NN | Initial HH | After printing 100,000 sheets NN | After printing 100,000 sheets HH | After printing 1,000,000 sheets NN | After printing 1,000,000 sheets HH |
|---|---|---|---|---|---|---|
| Example 2-7 | A | A | A | A | B | B |
| Example 2-8 | A | A | A | A | B | B |
| Example 2-9 | A | A | A | A | B | B |
| Example 2-10 | A | A | A | A | B | B |
| Example 2-11 | A | A | A | A | A | B |
| Example 2-12 | A | A | A | A | A | A |
| Comp. Example 2-4 | A | A | A | B | C | C |
| Comp. Example 2-5 | A | A | B | C | C | D |
| Comp. Example 2-6 | A | A | B | B | B | C |

| Kind of resin-coated carrier | Evaluation of printing stability Gradation: Initial NN | Initial HH | After printing 100,000 sheets NN | After printing 100,000 sheets HH | After printing 1,000,000 sheets NN | After printing 1,000,000 sheets HH |
|---|---|---|---|---|---|---|
| Example 2-7 | A | A | A | B | C | C |
| Example 2-8 | A | A | A | B | C | C |
| Example 2-9 | A | A | A | B | B | C |
| Example 2-10 | A | A | A | B | B | C |
| Example 2-11 | A | A | A | A | A | B |
| Example 2-12 | A | A | A | A | A | B |
| Comp. Example 2-4 | A | A | B | C | D | D |
| Comp. Example 2-5 | D | E | E | E | E | E |
| Comp. Example 2-6 | D | D | D | E | E | E |

As shown in Table 9, the magnetic carriers and the developers according to the present invention were excellent in adhesion to the coating resins without occurrence of peeling-off and abrasion of the resins when subjected to durability test, and further had a small voltage dependency of electric resistance value thereof and exhibited an adequate electric resistance value, so that uniform solid black images having an excellent image quality and a high image density could be reproduced. In addition, by subjecting the ferromagnetic iron oxide particles to coating treatment to form a melamine resin coating layer thereon, it was possible to adequately control the electric resistance of the magnetic carriers and maintain a less voltage dependency thereof over a long period of time. As a result, it was confirmed that the magnetic carriers obtained according to the present invention were capable of forming images having an excellent gradation even after printing 1,000,000 sheets.

Examples and Comparative Examples Using Dielectric Particles

Lipophilic Treatment 5

1000 parts of magnetite (iron oxide particles 4) having a particle diameter of 0.35 μm were charged into a flask, and then 5.0 parts of an epoxy group-containing silane-based coupling agent ("KBM-403" (tradename) produced by Shin-Etsu Chemical Co., Ltd.) were added to the flask, followed by stirring the contents of the flask. Then, the contents of the flask were heated to about 100° C., and intimately mixed and stirred at that temperature for 30 min, thereby obtaining ferromagnetic iron oxide particles (a) coated with the silane-based coupling agent.

Lipophilic Treatment 6

1000 parts of magnetite (iron oxide particles 1) having a particle diameter of 0.23 μm were charged into a flask, and then 10.0 parts of an epoxy group-containing silane-based coupling agent ("KBM-403" (tradename) produced by Shin-Etsu Chemical Co., Ltd.) were added to the flask, followed by stirring the contents of the flask. Then, the contents of the flask were heated to about 100° C. and intimately mixed and stirred at that temperature for 30 min, thereby obtaining ferromagnetic iron oxide particles (b) coated with the silane-based coupling agent.

Lipophilic Treatment 7

1000 parts of $TiO_2$ having a particle diameter of 1.0 μm were charged into a flask, and then 5.0 parts of an epoxy group-containing silane-based coupling agent ("KBM-403" (tradename) produced by Shin-Etsu Chemical Co., Ltd.) were added to the flask, followed by stirring the contents of the flask. Then, the contents of the flask were heated to about 100° C. and intimately mixed and stirred at that temperature for 30 min, thereby obtaining high-dielectric particles (c) coated with the silane-based coupling agent.

Lipophilic Treatment 8

1000 parts of magnetite (iron oxide particles 4) having a particle diameter of 0.35 μm, 600 parts of magnetite having a particle diameter of 0.23 μm and 300 parts of $CaTiO_3$ were charged into a flask, and then 10.0 parts of an epoxy group-containing silane-based coupling agent ("KBM-403" (tradename) produced by Shin-Etsu Chemical Co., Ltd.) were added to the flask, followed by stirring the contents of the flask. Then, the contents of the flask were heated to about 100° C. and intimately mixed and stirred at that temperature for 30 min, thereby obtaining mixed particles respectively coated with the silane-based coupling agent.

Example 3-1

Mixing after Lipophilic Treatment

A flask was charged with 30 parts of the high-dielectric particles (c) subjected to the lipophilic treatment 7 and 70 parts of the ferromagnetic iron oxide particles (b) subjected to the lipophilic treatment 2 (rc/rb=4.3), and the contents of the flask were mixed at a stirring speed of 250 rpm for 30 min, thereby obtaining mixed particles.

<Production of Spherical Magnetic Composite Particles>

| | |
|---|---|
| Phenol | 12 parts |
| 37% Formalin | 18 parts |
| Mixed particles of high-dielectric particles (c) and ferromagnetic iron oxide particles (b) | 100 parts |
| 25% Aqueous ammonia | 4.2 parts |
| Water | 15 parts |

The above materials were charged into a 1-L four-necked flask, and heated to 85° C. over 60 min while stirring at a stirring speed of 250 rpm, and then the contents of the flask were reacted and cured at the same temperature for 120 min, thereby producing spherical composite magnetic particles comprising the ferromagnetic iron oxide particles (b), the high-dielectric particles (c) and a cured phenol resin.

Next, the contents of the flask were cooled to 30° C., and then a supernatant liquid was removed therefrom. Further, the resulting precipitate as a lower layer was washed with water and then air-dried. Next, the dried precipitate was dried at a temperature of 150 to 200° C. under reduced pressure (not more than 5 mmHg) to obtain spherical magnetic composite particles.

As a result, it was confirmed that the resulting spherical magnetic composite particles had an average particle diameter of 35 μm; an apparent relative dielectric constant $\in$ of 20; an electric resistance value $R_{100}$ of $9.5\times10^{12}$ Ω·cm as measured upon applying a voltage of 100 V thereto; an electric resistance value $R_{300}$ of $7.5\times10^{12}$ Ω·cm as measured upon applying a voltage of 300 V thereto; a ten-point mean roughness Rz of 0.60 μm; a maximum height Ry of 1.20 μm; an arithmetic mean roughness Ra of 0.22 μm; a mean spacing of profile irregularities Sm of 1.20 μm; a specific gravity of 3.43 g/cm$^3$; a saturation magnetization value of 61.5 Am$^2$/kg; and a sphericity (l/w) of 1.1.

As a result of observing the thus obtained spherical composite particles using SEM, it was confirmed that the respective spherical composite particles had a particle shape close to a sphere, and were provided on the surface thereof with protruded portions owing to the high-dielectric particles (c), so that fine surface irregularities were formed on the surface of the respective particles.

The production conditions of the resulting spherical magnetic composite particles are shown in Table 10, and various properties thereof are shown in Table 11.

Examples 3-2 to 3-4 and Comparative Example 3-2

The same procedure as defined in Example 3-1 was conducted under the same conditions except that the kinds of ferromagnetic iron oxide particles (a), ferromagnetic iron oxide particles (b) and dielectric particles (c) and the mixing ratio therebetween, the kind of lipophilic treatment agent and the production conditions of spherical magnetic composite particles were changed variously, thereby obtaining the spherical composite magnetic particles. Meanwhile, the relative dielectric constants of the respective compounds are as follows: $TiO_2$: 100; $BaTiO_3$: 1500; $SrTiO_3$: 250; $CaTiO_3$: 150.

The production conditions of the resulting spherical magnetic composite particles are shown in Table 10, and various properties thereof are shown in Table 11.

Comparative Example 3-1

The same procedure as defined in Example 2-1 was conducted under the same conditions except that the ferromagnetic iron oxide particles (a) and the dielectric particles (c) respectively subjected to lipophilic treatment were used for production of spherical composite magnetic particles without being mixed with each other, thereby obtaining the spherical composite magnetic particles.

The production conditions of the resulting spherical magnetic composite particles are shown in Table 10, and various properties of the spherical magnetic composite particles and the results of forced deterioration test thereof are shown in Table 11.

TABLE 10

| Examples and Comp. Examples | Ferromagnetic iron oxide particles(a) Kind | Lipophilic treatment agent Kind | Ferromagnetic iron oxide particles(b) Kind | Lipophilic treatment agent Kind |
|---|---|---|---|---|
| Example 3-1 | — | — | Iron oxide particles 1 | KBM403 |
| Example 3-2 | — | — | Iron oxide particles 1 | KBM903 |
| Example 3-3 | — | — | Iron oxide particles 1 | GLYMO |
| Example 3-4 | Iron oxide particles 4 | * | Iron oxide particles 10 | * |
| Comp. Example 3-1 | — | — | Iron oxide particles 1 | KBM403 |
| Comp. Example 3-2 | — | — | Iron oxide particles 1 | KBM403 |

| Examples and Comp. Examples | Dielectric particles (c) Kind | Average particle diameter rc [μm] | Lipophilic treatment agent Kind |
|---|---|---|---|
| Example 3-1 | $TiO_2$ | 1.0 | KBM403 |
| Example 3-2 | $BaTiO_3$ | 1.5 | KBM903 |
| Example 3-3 | $SrTiO_3$ | 0.83 | GLYMO |
| Example 3-4 | $CaTiO_3$ | 2.0 | * |
| Comp. Example 3-1 | $TiO_2$ | 1.0 | KBM403 |
| Comp. Example 3-2 | $TiO_2$ | 1.0 | KBM403 |

| Examples and Comp. Examples | Particle diameter ratio ra/rb | Particle diameter ratio rc/rb | Mixing ratio a/b/c [part(s)] | Basic catalyst Kind | Basic catalyst Amount (part(s) |
|---|---|---|---|---|---|
| Example 3-1 | — | 4.3 | 0/70/30 | Aqueous ammonia | 4.2 |
| Example 3-2 | — | 6.5 | 0/80/20 | Aqueous ammonia | 3.5 |
| Example 3-3 | — | 3.6 | 0/95/5 | Aqueous ammonia | 4.6 |
| Example 3-4 | 1.5 | 8.7 | 10/60/30 | Aqueous ammonia | 4.2 |
| Comp. Example 3-1 | — | 4.3 | 0/70/30 | Aqueous ammonia | 3.5 |
| Comp. Example 3-2 | — | 4.3 | 0/30/70 | Aqueous ammonia | 3.5 |

| Examples and Comp. Examples | Binder resin Kind | Binder resin Amount [part(s)] | Aldehyde compound Kind | Aldehyde compound Amount [part(s)] | Water Amount [part(s)] |
|---|---|---|---|---|---|
| Example 3-1 | Phenol | 12.0 | Formalin | 18.0 | 15.0 |
| Example 3-2 | Phenol | 10.0 | Formalin | 15.0 | 15.0 |
| Example 3-3 | Phenol | 13.0 | Formalin | 19.5 | 15.0 |
| Example 3-4 | Phenol | 12.0 | Formalin | 18.0 | 15.0 |
| Comp. Example 3-1 | Phenol | 10.0 | Formalin | 15.0 | 15.0 |
| Comp. Example 3-2 | Phenol | 10.0 | Formalin | 15.0 | 15.0 |

| Examples and Comp. Examples | Temperature [° C.] | Time [min] | Heat treatment conditions [° C. × Hr] |
|---|---|---|---|
| Example 3-1 | 85 | 120 | 200 × 10 |
| Example 3-2 | 85 | 120 | 200 × 10 |
| Example 3-3 | 80 | 120 | 200 × 10 |
| Example 3-4 | 85 | 120 | 200 × 10 |
| Comp. Example 3-1 | 85 | 120 | 200 × 10 |
| Comp. Example 3-2 | 85 | 120 | 200 × 10 |

Note

* 10 g of KBM403 were added to a mixture prepared by fully mixing 100 g of ferromagnetic iron oxide particles (a), 600 g of ferromagnetic iron oxide particles (b) and 300 g of high-dielectric particles (c), and the resulting mixture was subjected to lipophilic treatment.

TABLE 11

| Examples and Comp. Examples | Properties of magnetic carrier: Average particle diameter [μm] | Shape | Rz [μm] | Ry [μm] |
|---|---|---|---|---|
| Example 3-1 | 35.0 | Spherical | 0.60 | 1.20 |
| Example 3-2 | 26.0 | Spherical | 2.00 | 2.30 |
| Example 3-3 | 42.0 | Spherical | 0.60 | 2.40 |
| Example 3-4 | 33.0 | Spherical | 1.50 | 1.70 |
| Comp. Example 3-1 | 53.0 | Spherical | 0.26 | 3.00 |
| Comp. Example 3-2 | 70.0 | Spherical | 2.50 | 3.00 |

| Examples and Comp. Examples | Properties of magnetic carrier: Ra [μm] | Sm [μm] | Relative dielectric constant ε [—] | Applied voltage: Electric resistance value at applied voltage of 100 V (Ω · cm) | Applied voltage: Electric resistance value at applied voltage of 300 V (Ω · cm) |
|---|---|---|---|---|---|
| Example 3-1 | 0.22 | 1.20 | 20 | 9.5E+12 | 7.5E+12 |
| Example 3-2 | 0.55 | 3.50 | 30 | 1.0E+12 | 5.8E+11 |
| Example 3-3 | 0.15 | 4.00 | 15 | 7.8E+09 | 3.6E+09 |
| Example 3-4 | 0.57 | 1.00 | 45 | 1.2E+11 | 8.8E+10 |
| Comp. Example 3-1 | 0.05 | 7.00 | 8.0 | 5.2E+10 | 4.1E+08 |
| Comp. Example 3-2 | 1.20 | 3.00 | 9.5 | 9.8E+13 | 9.0E+11 |

| Examples and Comp. Examples | Properties of magnetic carrier: $R_{300}/R_{100}$ | Content (a + b + c) [%] | Specific gravity [g/cm$^3$] | Saturation magnetization value [Am$^2$/kg] |
|---|---|---|---|---|
| Example 3-1 | 0.79 | 88.5 | 3.43 | 61.5 |
| Example 3-2 | 0.58 | 88.5 | 3.55 | 67.3 |
| Example 3-3 | 0.46 | 88.7 | 3.76 | 71.5 |
| Example 3-4 | 0.73 | 88.8 | 3.45 | 62.3 |
| Comp. Example 3-1 | 0.01 | 83.0 | 3.65 | 70.5 |
| Comp. Example 3-2 | 0.01 | 80.0 | 3.23 | 25.5 |

| Examples and Comp. Examples | Properties of magnetic carrier Sphericity [l/w] | Forced deterioration test Rate of change in resistance |
|---|---|---|
| Example 3-1 | 1.1 | A |
| Example 3-2 | 1.1 | A |
| Example 3-3 | 1.1 | A |
| Example 3-4 | 1.1 | A |
| Comp. Example 3-1 | 1.1 | D |

TABLE 11-continued

| | | |
|---|---|---|
| Comp. Example 3-2 | 1.1 | D |

Note
** Not measurable because of excessively low electric resistance value

Production of Resin-Coated Carrier

Example 3-5

Under a nitrogen flow, a Henschel mixer was charged with 1000 parts of the spherical magnetic composite particles obtained in Example 3-1, 10 parts as a solid content of a silicone-based resin (tradename "KR251" produced by Shin-Etsu Chemical Co., Ltd.) and 1.5 parts of carbon black (tradename "TOKABLACK #4400" produced by Tokai Carbon Co., Ltd.), and the contents of the Henschel mixer were stirred at a temperature of 50 to 150° C. for 1 hr, thereby forming a resin coating layer formed of the silicone-based resin comprising carbon black on the surface of the respective particles.

The thus obtained resin-coated magnetic carrier had an average particle diameter of 37 μm, a specific gravity of 3.26 g/cm$^3$, a saturation magnetization value of 60.9 Am$^2$/kg, an electric resistance value $R_{100}$ of $9.8\times10^{14}$ Ω·cm as measured upon applying a voltage of 100 V thereto, and an electric resistance value $R_{300}$ of $8.8\times10^{14}$ Ω·cm as measured upon applying a voltage of 300 V thereto.

The silicone-based resin coating layer of the thus obtained resin-coated carrier particles 1 was observed using a scanning electron microscope ("S-4800" manufactured by Hitachi Ltd.). As a result, it was confirmed that the resin coating layer was uniformly and sufficiently formed.

Examples 3-6 to 3-8 and Comparative Examples 3-3 to 3-4

The same procedure as defined in Example 3-5 was conducted under the same conditions except that the kind of spherical composite particles, the kind of coating resin and the resin coating amount were variously changed, thereby obtaining resin-coated magnetic carriers.

The production conditions and various properties of the thus obtained resin-coated magnetic carriers are shown in Table 12, and the results of evaluations of a durability, a forced deterioration test and a printing stability thereof are shown in Table 13.

TABLE 12

| | | Composition of resin coating layer of magnetic carrier | | | |
|---|---|---|---|---|---|
| | | Coating resin | | Additives | |
| Examples and Comp. Examples | Kind of core particles | Kind | Ratio to core material [%] | Kind | Ratio to resin [%] |
| Example 3-5 | Example 3-1 | Silicone-based resin | 1.0 | Carbon black | 15 |
| Example 3-6 | Example 3-2 | Silicone-based resin | 1.0 | Carbon black | 15 |
| Example 3-7 | Example 3-3 | Silicone-based resin | 1.5 | Carbon black | 15 |
| Example 3-8 | Example 3-4 | Styrene-acryl-based resin | 1.0 | Carbon black | 15 |
| Comp. Example 3-3 | Comp. Example 3-1 | Silicone-based resin | 1.0 | Carbon black | 15 |
| Comp. Example 3-4 | Comp. Example 3-2 | Silicone-based resin | 1.0 | Carbon black | 15 |

| | Properties of magnetic carrier having resin coating layer | | |
|---|---|---|---|
| Examples and Comp. Examples | Average particle diameter [μm] | Specific gravity [g/cm$^3$] | Saturation magnetization value [Am$^2$/kg] |
| Example 3-5 | 37 | 3.26 | 60.9 |
| Example 3-6 | 29 | 3.37 | 66.6 |
| Example 3-7 | 44 | 3.57 | 70.8 |
| Example 3-8 | 35 | 3.28 | 61.7 |
| Comp. Example 3-3 | 56 | 3.47 | 69.8 |
| Comp. Example 3-4 | 73 | 3.07 | 25.3 |

| | Properties of magnetic carrier having resin coating layer | | |
|---|---|---|---|
| Examples and Comp. Examples | Electric resistance $R_{100}$ (Ω · cm) | Electric resistance $R_{300}$ (Ω · cm) | $R_{300}/R_{100}$ |
| Example 3-5 | 9.8E+14 | 8.8E+14 | 0.90 |
| Example 3-6 | 1.6E+13 | 1.0E+13 | 0.63 |
| Example 3-7 | 3.2E+14 | 2.2E+14 | 0.69 |
| Example 3-8 | 3.3E+13 | 2.8E+13 | 0.85 |
| Comp. Example 3-3 | 8.8E+13 | 4.2E+12 | 0.05 |
| Comp. Example 3-4 | 2.3E+14 | 9.8E+12 | 0.04 |

TABLE 13

| | | | Forced deterioration test | | |
|---|---|---|---|---|---|
| | Durability test | | Rate of change in | Rate of change in | |
| Examples and Comp. Examples | Dura-bility | Surface condition | charge amount | electric resistance | Surface condition |
| Example 3-5 | A | A | A | A | A |
| Example 3-6 | A | A | A | A | A |
| Example 3-7 | A | A | A | A | A |
| Example 3-8 | A | A | A | A | A |
| Comp. Example 3-3 | B | B | B | B | B |
| Comp. Example 3-4 | C | B | B | A | B |

| | Evaluation of printing stability Image density | | | | | |
|---|---|---|---|---|---|---|
| Examples and | Initial | | After printing 100,000 sheets | | After printing 1,000,000 sheets | |
| Comp. Examples | NN | HH | NN | HH | NN | HH |
| Example 3-5 | A | A | A | A | B | C |
| Example 3-6 | A | A | A | A | B | B |
| Example 3-7 | A | A | A | A | C | C |
| Example 3-8 | A | A | A | A | A | B |

TABLE 13-continued

| | | | | | | |
|---|---|---|---|---|---|---|
| Comp. Example 3-3 | C | C | C | D | D | E |
| Comp. Example 3-4 | C | D | D | E | E | E |

| | Evaluation of printing stability Fogging | | | | | |
|---|---|---|---|---|---|---|
| Examples and | Initial | | After printing 100,000 sheets | | After printing 1,000,000 sheets | |
| Comp. Examples | NN | HH | NN | HH | NN | HH |
| Example 3-5 | A | A | A | A | B | B |
| Example 3-6 | A | A | A | A | A | B |
| Example 3-7 | A | A | A | A | B | B |
| Example 3-8 | A | A | A | A | A | A |
| Comp. Example 3-3 | B | B | D | D | D | D |
| Comp. Example 3-4 | D | D | D | D | D | D |

| | Evaluation of printing stability Gradation | | | | | |
|---|---|---|---|---|---|---|
| Examples and | Initial | | After printing 100,000 sheets | | After printing 1,000,000 sheets | |
| Comp. Examples | NN | HH | NN | HH | NN | HH |
| Example 3-5 | A | A | A | A | B | B |
| Example 3-6 | A | A | A | A | B | C |
| Example 3-7 | A | A | A | B | C | C |
| Example 3-8 | A | A | A | A | A | B |
| Comp. Example 3-3 | C | C | D | E | E | E |
| Comp. Example 3-4 | D | D | E | E | E | E |

As shown in Table 13, the magnetic carriers and the developers according to the present invention were excellent in adhesion to the coating resins without occurrence of peeling-off and abrasion of the resins when subjected to durability test, and further had a less voltage dependency of electric resistance value thereof and exhibited an adequate electric resistance value, so that uniform solid black images having an excellent image quality and a high image density could be reproduced. In addition, by using the ferromagnetic iron oxide particles subjected to coating treatment, it was possible to adequately control the electric resistance of the magnetic carriers and maintain a less voltage dependency thereof over a long period of time. As a result, it was confirmed that the magnetic carriers obtained according to the present invention were capable of forming images having an excellent gradation even after printing 1,000,000 sheets.

INDUSTRIAL APPLICABILITY

The magnetic carrier according to the present invention is provided on the surface thereof with fine irregularities which are well controlled to such an extent that the carrier is allowed to exhibit an excellent adhesion property to coating resins and no severe load is applied onto protruded portions of the irregularities. Therefore, the magnetic carrier exhibits an excellent durability against peeling-off and abrasion of coating resins formed thereon and a high stability to mechanical stress exerted onto the carrier, is free from occurrence of spent toner, can be stably held over a long period of time without occurrence of fogging and unevenness in density of toner images, and can keep high-quality images with an excellent gradation for a long period of time owing to a less voltage dependency of the electric resistance value. As a result, since the magnetic carrier and the developer of the present invention can satisfy the recently demanded requirements. Therefore, the magnetic carrier and the developer of the present invention can be suitably used as a magnetic carrier used in an electrophotographic developer and as a two-component system developer comprising the magnetic carrier fro an electrophotographic developer and a toner, respectively.

The invention claimed is:

1. A magnetic carrier for an electrophotographic developer comprising spherical magnetic composite particles comprising a phenol resin as a binder and ferromagnetic iron oxide particles bonded to each other through the phenol resin, and further comprising on the spherical magnet particles a coating layer comprising at least one resin selected from the group consisting of a melamine resin, a silicone-based resin, a fluororesin, an acrylic resin and a styrene-acrylic resin, wherein the spherical magnetic composite particles before coating with the coating layer have a ten-point mean roughness Rz of 0.3 to 2.0 μm, a total content of the ferromagnetic iron oxide particles in the spherical magnetic composite particles is 80 to 99% by weight, the ferromagnetic iron oxide particles are constituted from ferromagnetic iron oxide particles (a) and ferromagnetic iron oxide particles (b) which are different in average particle diameter from each other, a ratio of an average particle diameter (ra) of the ferromagnetic iron oxide particles (a) having a larger average particle diameter to an average particle diameter (rb) of the ferromagnetic iron oxide particles (b) having a smaller average particle diameter (ra/rb) is more than 1, a content of the ferromagnetic iron oxide particles (a) is 1 to 50% by weight based on a total amount of the ferromagnetic iron oxide particles (a) and the ferromagnetic iron oxide particles (b), and the ferromagnetic iron oxide particles (a) and the ferromagnetic iron oxide particles (b) respectively have any shape selected from the group consisting of a spherical shape, a hexahedral shape, an octahedral shape, a polyhedral shape and an amorphous shape.

2. A magnetic carrier for an electrophotographic developer according to claim 1, wherein a maximum height Ry as measured on a surface of the respective spherical magnetic composite particles is in the range of 0.7 to 2.5 μm.

3. A magnetic carrier for an electrophotographic developer according to claim 1, wherein an arithmetic mean roughness Ra as measured on a surface of the respective spherical magnetic composite particles is in the range of 0.1 to 0.9 μm, and a mean spacing Sm of profile irregularities thereon is in the range of 0.6 to 6.0 μm.

4. A magnetic carrier for an electrophotographic developer according to claim 1, wherein the magnetic carrier for an electrophotographic developer has an electric resistance value $R_{100}$ of $1\times10^{8}$ Ω·cm to $1\times10^{16}$Ωcm as measured when applying a voltage of 100 V thereto, and an electric resistance value $R_{300}$ of the magnetic carrier as measured when applying a voltage of 300 V thereto is controlled such that a ratio of $R_{300}/R_{100}$ satisfies the formula: $0.1\leq R_{300}/R_{100}\leq 1$.

5. A magnetic carrier for an electrophotographic developer according to claim 1, wherein the spherical magnetic composite particles further comprise dielectric particles having a relative dielectric constant of not less than 50.

6. A magnetic carrier for an electrophotographic developer according to claim 5, wherein the dielectric particles are formed of at least one material selected from the group consisting of titanium oxide, a titanate and a zirconate.

7. A magnetic carrier for an electrophotographic developer according to claim 5, wherein a total content of the dielectric particles and the ferromagnetic iron oxide particles in the spherical magnetic composite particles is 80 to 99% by weight; and a content of the dielectric particles in the spherical magnetic composite particles is 1 to 50% by weight based on a total amount of the ferromagnetic iron oxide particles and the dielectric particles.

8. A magnetic carrier for an electrophotographic developer according to claim 5, wherein the ferromagnetic iron oxide particles consist of one kind of ferromagnetic iron oxide particles (b') solely; a ratio of an average particle diameter (rc) of the dielectric particles to an average particle diameter (rb') of the ferromagnetic iron oxide particles (b') (rc/rb') is more than 1; and the ferromagnetic iron oxide particles (b') have any particle shape selected from the group consisting of a spherical shape, a hexahedral shape, an octahedral shape, a polyhedral shape and an amorphous shape.

9. A magnetic carrier for an electrophotographic developer according to claim 5, wherein the ferromagnetic iron oxide particles are constituted from ferromagnetic iron oxide particles (a") and ferromagnetic iron oxide particles (b") which are different in average particle diameter from each other; a ratio of an average particle diameter (ra") of the ferromagnetic iron oxide particles (a") to an average particle diameter (rb") of the ferromagnetic iron oxide particles (b") (ra"/rb") is more than 1; a ratio of the average particle diameter (rc) of the dielectric particles to the average particle diameter (rb") of the ferromagnetic iron oxide particles (b") (rc/rb") is more than 1; a content of the ferromagnetic iron oxide particles (a") is less than 49% by weight based on a total amount of the ferromagnetic iron oxide particles (a"), the ferromagnetic iron oxide particles (b") and the dielectric particles; and the ferromagnetic iron oxide particles (a") and the ferromagnetic iron oxide particles (b") respectively have any shape selected from the group consisting of a spherical shape, a hexahedral shape, an octahedral shape, a polyhedral shape and an amorphous shape.

10. A process for producing the magnetic carrier for an electrophotographic developer as defined in claim 1, said process comprising the step of mixing and reacting mixed particles comprising two kinds of ferromagnetic iron oxide particles which are different in average particle diameter from each other, with a phenol compound and an aldehyde compound in an aqueous medium while stirring to obtain a cured product, thereby producing spherical magnetic composite particles comprising the ferromagnetic iron oxide particles and a phenol resin, wherein the spherical magnetic composite particles are provided, on a surface thereof, with fine irregularities owing to a shape of the ferromagnetic iron oxide particles having a larger average particle diameter.

11. A process for producing the magnetic carrier for an electrophotographic developer as defined in claim 5, said process comprising the step of reacting ferromagnetic iron oxide particles and dielectric particles having a relative dielectric constant of not less than 50, with a phenol compound and an aldehyde compound in an aqueous medium to obtain a cured product, thereby producing spherical magnetic composite particles comprising the ferromagnetic iron oxide particles, the dielectric particles and a phenol resin, wherein the spherical magnetic composite particles are provided, on a surface thereof, with fine irregularities owing to a shape of the dielectric particles.

12. A process for producing the magnetic carrier for an electrophotographic developer as defined in claim 5, said process comprising the step of reacting two kinds of ferromagnetic iron oxide particles which are different in average particle diameter from each other and dielectric particles having a relative dielectric constant of not less than 50, with a phenol compound and an aldehyde compound in an aqueous medium to obtain a cured product, thereby producing spherical magnetic composite particles comprising the ferromagnetic iron oxide particles, the dielectric particles and a phenol resin, wherein the spherical magnetic composite particles are provided, on a surface thereof, with fine irregularities owing to shapes of the ferromagnetic iron oxide particles having a larger average particle diameter and the dielectric particles.

13. A process according to claim 10, further comprising the step of adding an acid aqueous solution comprising an acid having an acid dissociation constant pKa of 3 to 6 as an acid catalyst and a methylol melamine aqueous solution to the aqueous medium comprising the spherical magnetic composite particles obtained in the step for production of the spherical magnetic composite particles, to form a coating layer of a melamine resin on the respective spherical magnetic composite particles.

14. A two-component system developer comprising the magnetic carrier for an electrophotographic developer as defined in claim 1 and a toner.

* * * * *